US006568300B1

(12) United States Patent
Steffe

(10) Patent No.: US 6,568,300 B1
(45) Date of Patent: May 27, 2003

(54) RATCHETING OPEN-END WRENCHES

(76) Inventor: Michael Steffe, 165 Alder Rd., Bolinas, CA (US) 94924

( * ) Notice: Subject to any disclaimer, the term of this patent is extended or adjusted under 35 U.S.C. 154(b) by 0 days.

(21) Appl. No.: 10/155,607

(22) Filed: May 23, 2002

Related U.S. Application Data

(62) Division of application No. 09/535,065, filed on Mar. 23, 2000.

(51) Int. Cl.[7] ..... B25B 13/12

(52) U.S. Cl. ..... 81/126; 81/143; 81/157; 81/165

(58) Field of Search ..... 81/126, 128, 143, 81/145, 157, 165

(56) References Cited

U.S. PATENT DOCUMENTS 1,391,251 A * 9/1921 Ginsburg ..... 81/165
1,506,362 A * 8/1924 Carman ..... 81/165
2,562,060 A * 7/1951 Pehrsson ..... 81/126
3,349,654 A * 10/1967 Nordgren ..... 81/126
3,926,077 A * 12/1975 Nordgren ..... 81/126
5,890,404 A * 4/1999 Stojanowski ..... 81/165
5,941,142 A * 8/1999 Janson ..... 81/165
6,145,415 A * 11/2000 Liu ..... 81/143
6,336,384 B1 * 1/2002 Huang ..... 81/165

* cited by examiner

*Primary Examiner*—James G. Smith
(74) *Attorney, Agent, or Firm*—Thomas M. Freiburger

(57) ABSTRACT

An adjustable wrench has a ratcheting feature by which its movable jaw retracts away from its fixed jaw when the handle is pulled in one direction, enabling the wrench to slip over the facets of a polygon-shaped nut, but which locks the jaws in position when the wrench handle is turned in the opposite direction. A jaw adjustment screw is positioned for rotation in the wrench head and is axially movable with the lower jaw, but only when a support wedge is slidingly retracted out from its normal position supporting the bottom end of the adjustment screw. The tool can have a ruled edge adjacent to the jaw for indicating jaw opening size. Another feature is a slidable fence device on the fixed jaw, to be moved slidably over a face of the nut when the wrench is in place, providing a stop against sliding of the wrench off the nut. Other optional features include a locking device to prevent the wedge from retracting, when ratcheting is not desired; and a wrench variation wherein the adjustment screw is eliminated and the jaw is simply moved into engagement with a nut via a slide button. Non-adjustable ratcheting wrenches are also disclosed.

11 Claims, 35 Drawing Sheets

90
12
11
22
10
72
94
46
13
18
32
34
74
90

90
182
184
170
182
200
182
182
192
184
203
170
178
182
170

RATCHETING OPEN-END WRENCHES

This application is a division of application Ser. No. 09/535,065, filed Mar. 23, 2000.

BACKGROUND INFORMATION

This invention concerns ratcheting wrenches which apply torque to a hexagon bolt or nut or other screw fastener in one work direction and release from the nut or bolt in the opposite direction, without having to remove the tool from the nut or bolt.

In a number of situations, a conventional ratcheting socket. wrench cannot be used. In some situations such a wrench may not be available. An open-end wrench, on the other hand, can be slipped over a hexagon-shaped fastener from the side, not only from the top as in a socket a wrench. However, using an open-end wrench is inconvenient in a situation where it is not possible to turn the wrench and nut or bolt in large arcs of movement. The open-end wrench has to be repeatedly removed from the nut or bolt and re-inserted, the small arc of rotational movement made, and then the process repeated, sometimes many times. This resetting of the tool for each fraction of a turn is very time-consuming. Some adjustable wrenches tend to become stuck on the nut if the adjustment screw is set tightly, causing further difficulty.

For such situations it is desirable to have an open-end wrench with a rachet feature, allowing application of torque to a hexagon bolt or nut in one work direction, while allowing slippage in the opposite rotational direction.

Several forms of ratcheting open-end wrenches are known. For examples, see U.S. Pat. Nos. 4,488,459, 5,095,782, 5,941,142, and 5,960,679. Some of the ratcheting open-end wrenches of these patents are adjustable to accommodate different sizes of fasteners.

SUMMARY OF THE INVENTION

In the invention described herein, ratcheting wrenches that ratcheted open-end wrenches, both adjustable and non-adjustable have unique and efficient mechanisms providing the ratcheting. In the preferred form of adjustable wrench, the ratcheting feature allows the movable jaw of the wrench to retract away from the fixed jaw when the handle is rotated in one direction, such that the wrench slips over the facets of a polygon-shaped nut. In the opposite direction or work direction, the ratcheting mechanism locks the jaws in position so that they cannot spread. A jaw adjustment screw, similar to that of a conventional open-end adjustable wrench, is positioned for rotation in the wrench head to adjust the lower jaw position, and is axially movable along with the lower jaw, but only when a support wedge is slidingly retracted out from its normal position supporting the bottom end of adjustment screw. Rotation of the wrench handle in the non-work direction, i.e. rotation away from the lower jaw, is effective to retract this support wrench and thus to allow retracting movement of the lower jaw to open the wrench. The wrench handle is pivotally connected to the wrench head, which includes the fixed upper jaw. When the wrench handle is pulled in the non-work direction, the handle pivots relative to the head, and a linkage member pivotally secured to the handle at a position back from the head pivot point of poles and retracts the support wedge, which progressively lowers the support level for the adjustment screw and lower jaw. The lower jaw and adjustment screw preferably are spring-biased toward the jaw-open position, and as the wrench is further rotated in the non-work direction, the jaw opens and the wrench slips to the next nut facet position, whereupon the jaws close again to the original position and the wrench handle returns to normal alignment with the wrench head, under the influence of another spring which urges the wrench toward the normal position.

In one particular embodiment, the wrench includes a slidable fence device on the fixed jaw, to be moved slidably over a face of the nut or bolt head when the wrench is in place, providing a stop against sliding of the wrench off the nut or bolt head.

Another optional feature is a locking device to prevent the wedge from retracting, when is not desired. For example, the tool may be needed in a tight place where the tool can only be used in one orientation that would otherwise result in ratcheting.

In another embodiment, the adjustment screw is eliminated and the jaw is simply moved into engagement with a nut via a slide button. In this embodiment a pair of matching racks of teeth are included between the movable jaw and the fixed head, each notch in the racks of teeth representing an incremental nut size for spacing between the jaws.

In one embodiment of a non-adjustable open-ended wrench, the wrench again has a fixed jaw, but this fixed jaw is rigidly secured to the wrench's handle. A movable jaw coacts with the fixed jaw such that both sides of a nut can be engaged. This movable jaw has a base end pivoted to the wrench handle, but such that the pivoted movable jaw can slide outwardly, spreading away from the fixed jaw as it slides. The pivot includes a slot so that pivot point itself can slide. A wedge at the end of the movable jaw slides along a jaw stabilizer which is formed in a fixed position as part of the handle. When the wrench is rotated in a non-work direction, i.e. away from the movable jaw, the movable jaw slides outwardly in being pulled by the corners of the polygon-shaped nut against the pressure of a spring which urges the movable jaw toward its normal position. Thus, the nut corners pull the movable jaw outwardly and allow it to slip over the facet and the corner of the nut, until a position is reached in which the two jaws are parallel to the next pair of opposed nut facets. At this point the movable jaw is forced by the spring back toward the handle. If the wrench is then rotated in the opposite direction, i.e. a work direction, in a rotational direction wherein the handle is moved toward the movable jaw, the movable jaw then becomes locked in position and the movement of the handle rotates the nut along with the wrench. The movable jaw stays in place, with its pivot axis at the bottom of the slot in the handle.

The wrenches described above increase the speed and convenience of removing or tightening a bolt or nut whenever a conventional ratcheting socket wrench cannot be used. The wrench can be slipped over any square or hexagon shape from the side, not only from the top. The adjustable ratcheting wrench replaces a set with many different sizes of wrenches and thus makes much more convenient some types of work in tight places, such as under a car where it is difficult and inconvenient to retrieve various sizes of wrenches for different fasteners. The adjustable wrench can be made in different sizes for different ranges of nut sizes, and also the handle can be made in different lengths, which can be substituted by removal of a few pins or pivot shafts. The handle can be foldable if desired, for better access in tight work places.

These and other objects, advantages and features of the invention will be apparent from the following description of a preferred embodiment, considered along with the accompanying drawings.

DESCRIPTION OF PREFERRED EMBODIMENTS

Figure 1:
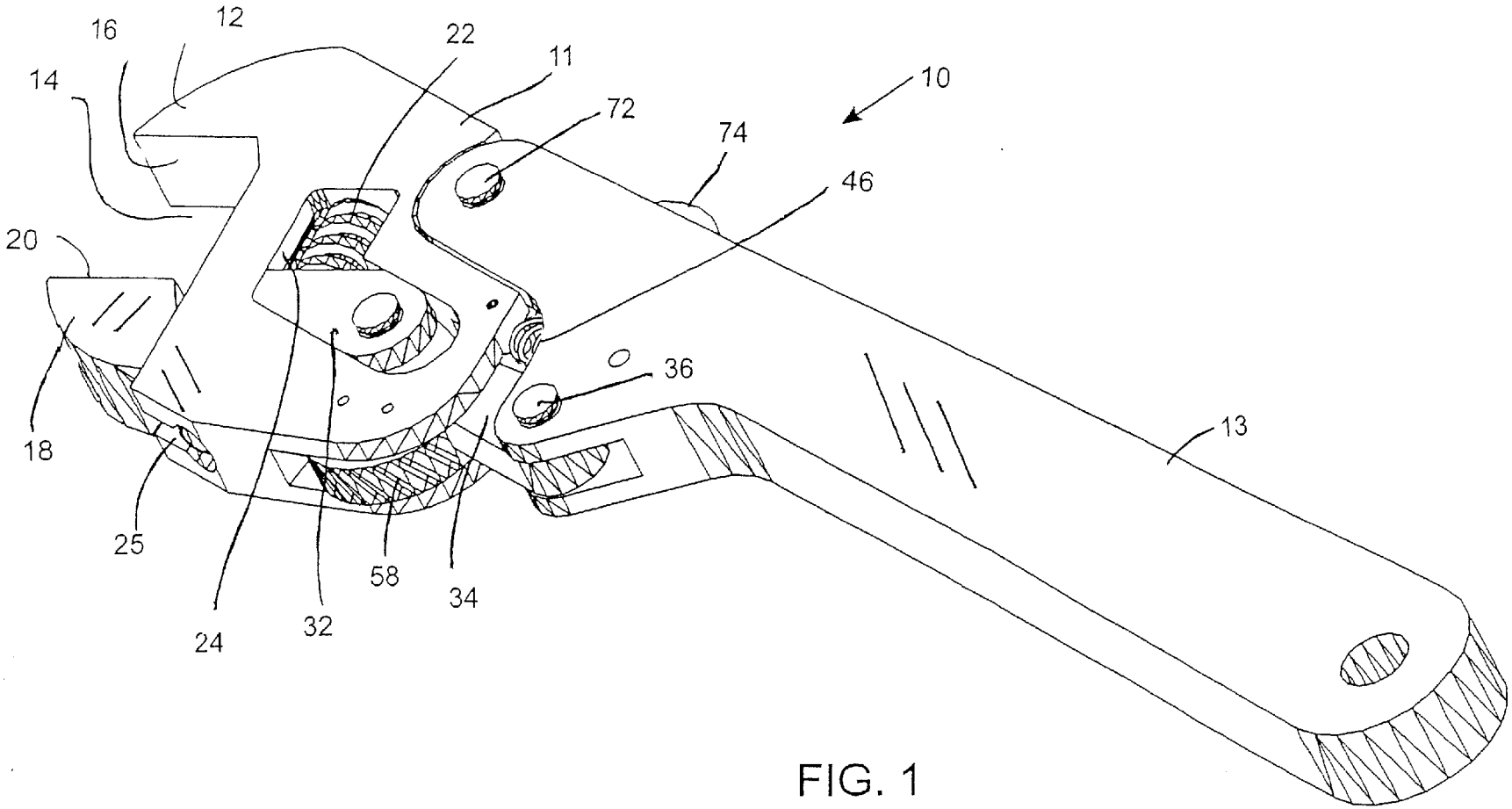
FIG. 1 is a perspective view showing one form of open-end ratcheting adjustable wrench according to the invention.

The drawings show several forms of open-end ratcheting wrenches. FIGS. 1 through 7B show a first form of adjustable ratcheting open-end wrench. The wrench 10 includes a wrench head 11 with a stationary or fixed jaw 12, pivotally secured to a handle 13. The head has an open nut-receiving area 14 adjacent to the fixed jaw's flat face 16, and opposite this face 16 is a movable jaw 18 with a similar and opposing parallel flat face 20. As can be seen particularly in FIGS. 1–4, the wrench head 11 also has an adjustment screw 22 which resides within a window 24 of the head and which engages with teeth 26 that form a part of the movable jaw 18. Thus, when the screw 22 is adjusted, as in a conventional adjustable open-end wrench, the jaw 18 rides in a slot 25 and moves closer to or farther from the fixed jaw 12, to accommodate the appropriate nut or bolt size. The generally barrel-shaped adjustment screw 22 is retained in the head by a pin 28, and a compression spring 30 bears against the screw 22 to urge it and the lower jaw downwardly, i.e. away from the fixed jaw 12.

The cut-out opening 24 in the wrench head 11 accommodates not only the adjustment screw but also a wedge 32. The cut-out 24 provides a sliding slot 24*a* for the wedge, which, as explained above, retracts by pulling of the handle in a direction away from the lower jaw (counterclockwise in FIGS. 1–4, which pulls in a retracting direction on the wedge 32 via a linkage arm 34. The linkage 34 is connected by short shafts or pins 36 to the handle, at a pivot point 38 and a handle slot 40, and to the back end of the wedge 32, at a pivot location 42, where a slot 44 is provided in the wedge. The linkage arm 34 could be eliminated in favor of a direct pivot connection from the handle to the wedge. In FIGS. 1, 3, 4, and 6, the wedge 32 is shown in its normal position fully supporting the adjustment screw 22, and this position is normally maintained by a tension spring 46 that is connected to the wrench handle 13 at 48 and to the wrench head 11 at 50, via pins 52.

The use of a slidable wedge to support the adjustment screw 22 affords mechanical advantage to prevent backing off of the jaw 18 in use of the wrench on a small nut, which when tight will exert great leverage trying to spread the jaws. Only a component of the reactive force tries to slide the wedge back, and the smaller the wedge angle, the smaller that force component.

Figure 4:
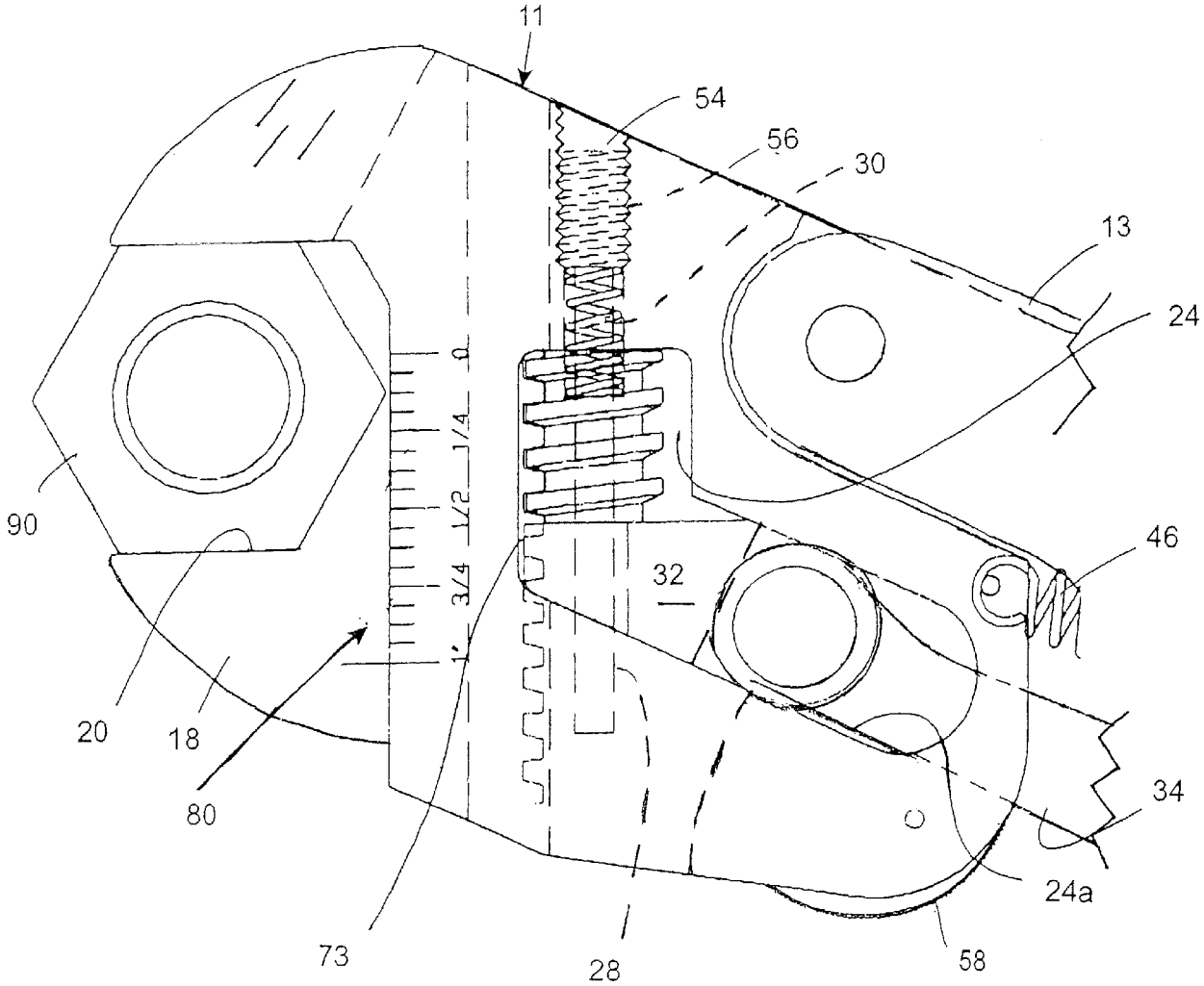
FIG. 4 is another side elevation view of the wrench, showing another feature.

As FIG. 4 shows, the pin or shaft 28 which secures the adjustment screw 22 and spring 30 within the head's recess or cut-out 24 is secured within a bore 54 in the wrench head, and the upper end of the pin has a screw thread 56 matched to the bore, so that the pin 28 is secured within the bore using a screw driver or Allen wrench.

The wrench head also has a knurled half wheel 58 preferably sunken into a slot 60 of the head. The continuation of this slot 60 also provides a pass way for the linkage are 34 through the lower portion of the wrench head, as well as a seat for the spring 46, retained via the pin 52. The half wheel or knob may be pinned in place by pins 62 as indicated in the exploded view of FIG. 2. Its primary function is to provide a convenient non-slip knurled surface for the user to open the jaws slightly using the thumb against the knurled surface, to reset the tool. For this function, the knurled half wheel 58 could be replaced by simply leaving this portion of the wrench head 11 solid and forming a knurled surface directly on this portion of the head.

Figure 2:
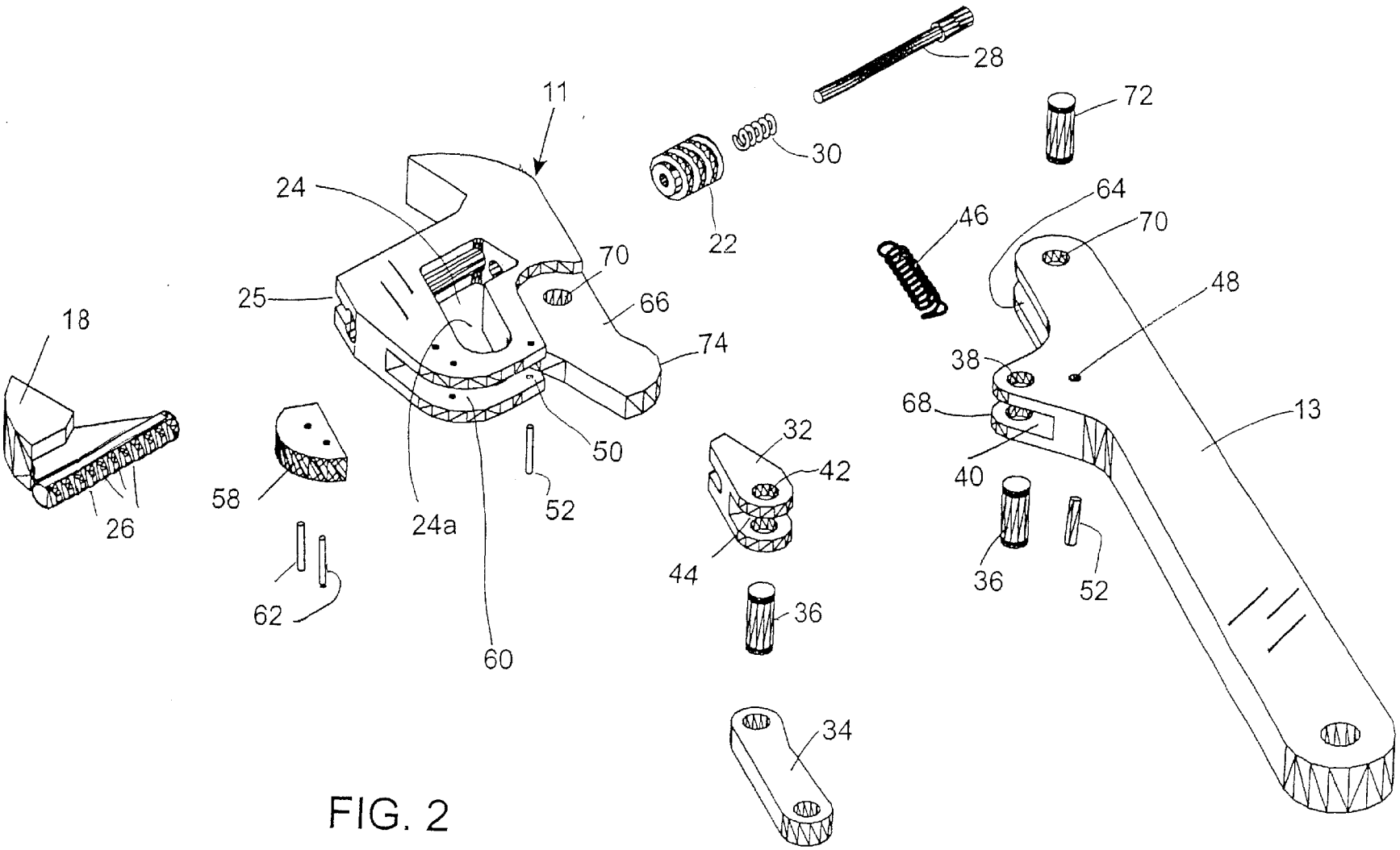
FIG. 2 is an exploded view of the wrench of FIG. 1.

The handle 13 in this embodiment has a slot 64 at the pivoting end to provide a seat for the stationary jaw or wrench head 11, which has a reduced-width tail portion 66 as shown in FIG. 2. This slot 64 can continue to and be contiguous with the slot 40 at the pivot point 38, thus also accommodating the linkage arm 34 and the spring 46. Where the slot 40 is formed, the handle extends out in a triangular or rectangular extension 68, in the downward direction as typically described herein, so that the linkage arm 34 is connected at an offset position relative to the length of the handle and its pivot connection at 70 to the wrench head tail extension 66. This connection is made by a pin 72 as seen in the exploded view of FIG. 2 and also in the other views.

FIG. 4 shows that in the fully supporting location of the wedge 32, i.e. its maximum upper-left position as in the drawing, a gap 73 exists between the forward end of the wedge and the wall of the head opening 24. This provides a positive jaw holding force during work rotation of the wrench, by transferring force from the handle, though compressive force in the linkage arm 34 to upward force on the adjustment member (screw) 22. Slippage of the nut in the jaws is virtually impossible.

Figure 3:
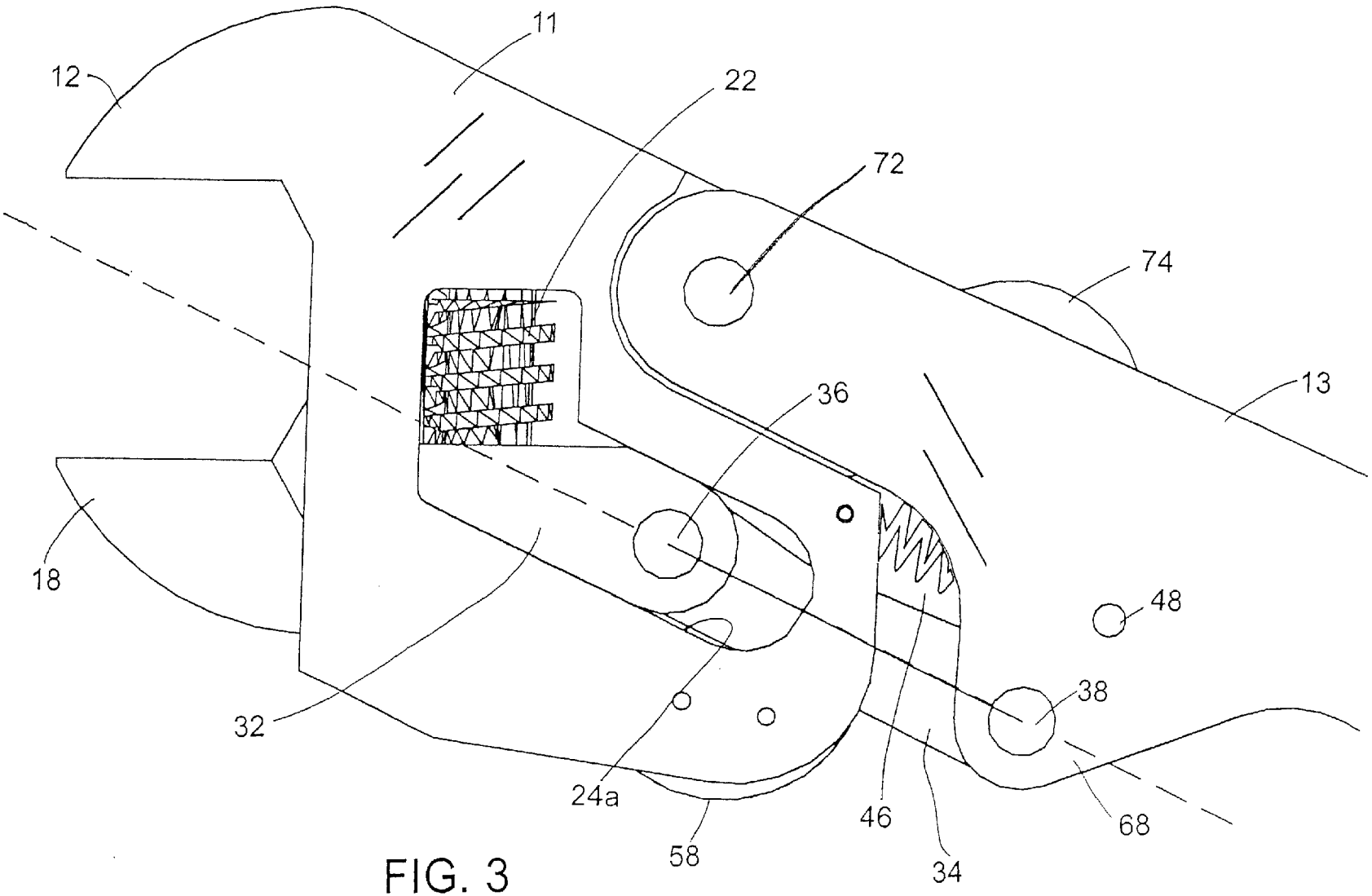
FIG. 3 is a side elevation view showing a portion of the wrench.

As shown in FIGS. 1 and 3, at the upper side of the handle can be included a protruding partially circular boss or knob 74 which provides a convenient pressure point for the thumb to open the jaws by pivoting the head relative to the handle. The knob 74 is integral with the head, as seen in FIG. 2.

Figure 6:
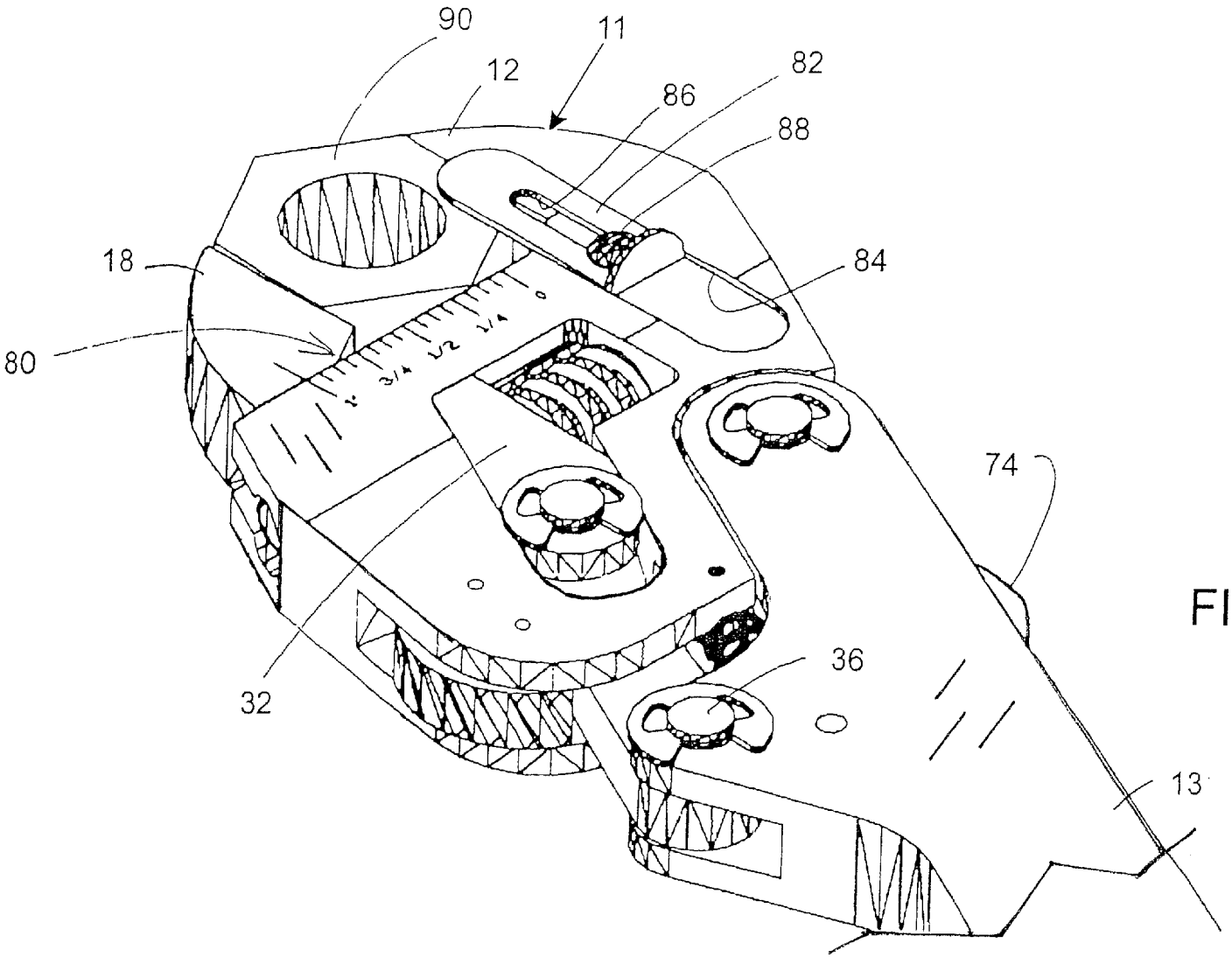
FIG. 6 is a perspective view showing another feature which can be included on the wrench.

Additional features which may be included in preferred embodiments of the wrench are shown in FIGS. 4, 6, 7A and 7B. FIG. 4 shows a scale 80 on the wrench head 11, to be read along the line of the planar face 20 of the adjustable lower jaw 18. This scale can be in English units (fractions of an inch), and the opposite side can have a metric scale, if desired. FIG. 6 also shows this nut or bolt size scale 80, along with a slidable fence 82 which is another optional feature. The fence 82 of fairly thin metal resides in a slot or recess 84 in the side of the wrench head, retained therein via a fence slot 86 through which passes a bolt or other fastener 88. When the slidable fence 82 is in the extended position as shown in FIG. 6, it blocks a portion of the opening between the two jaw faces 16 and 20, thus enabling a user to rest this fence against the nut 90 or other fastener while tightening or loosening the nut, without being concerned about slippage off the nut.

Figure 7B:
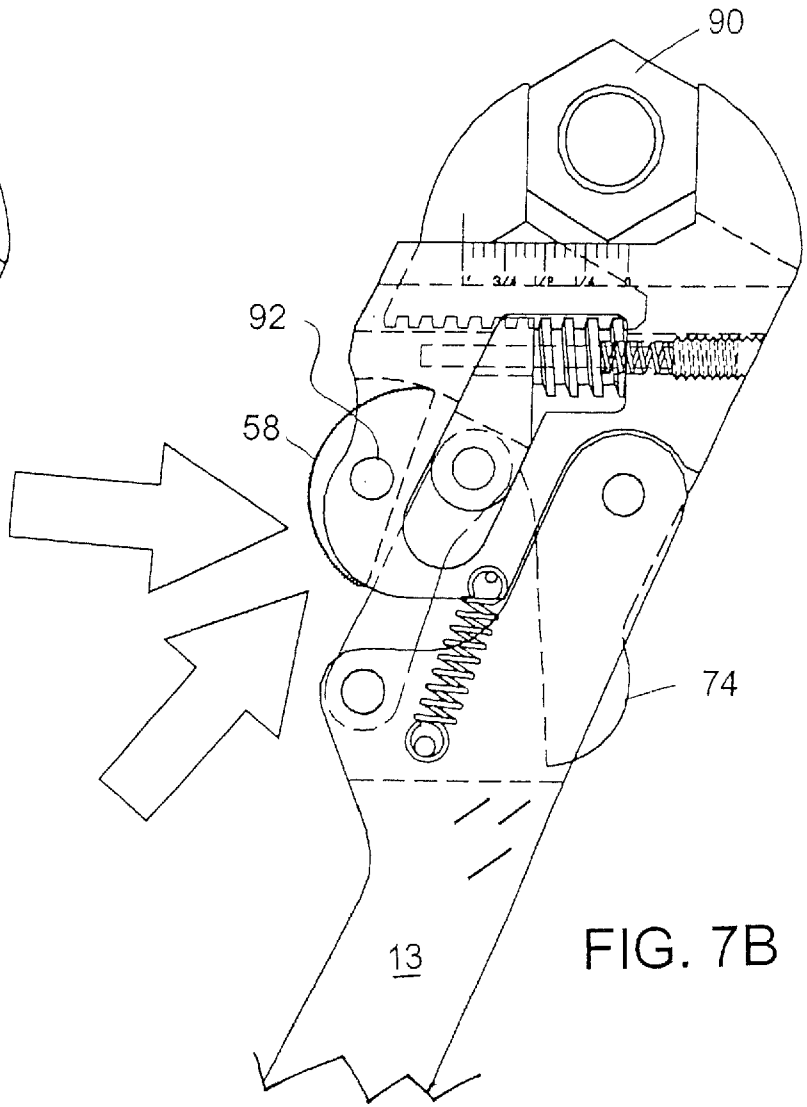
FIGS. 7A and 7B are companion elevation or plan views showing another feature of the wrench, whereby the ratcheting feature can be locked out.
Figure 7A:
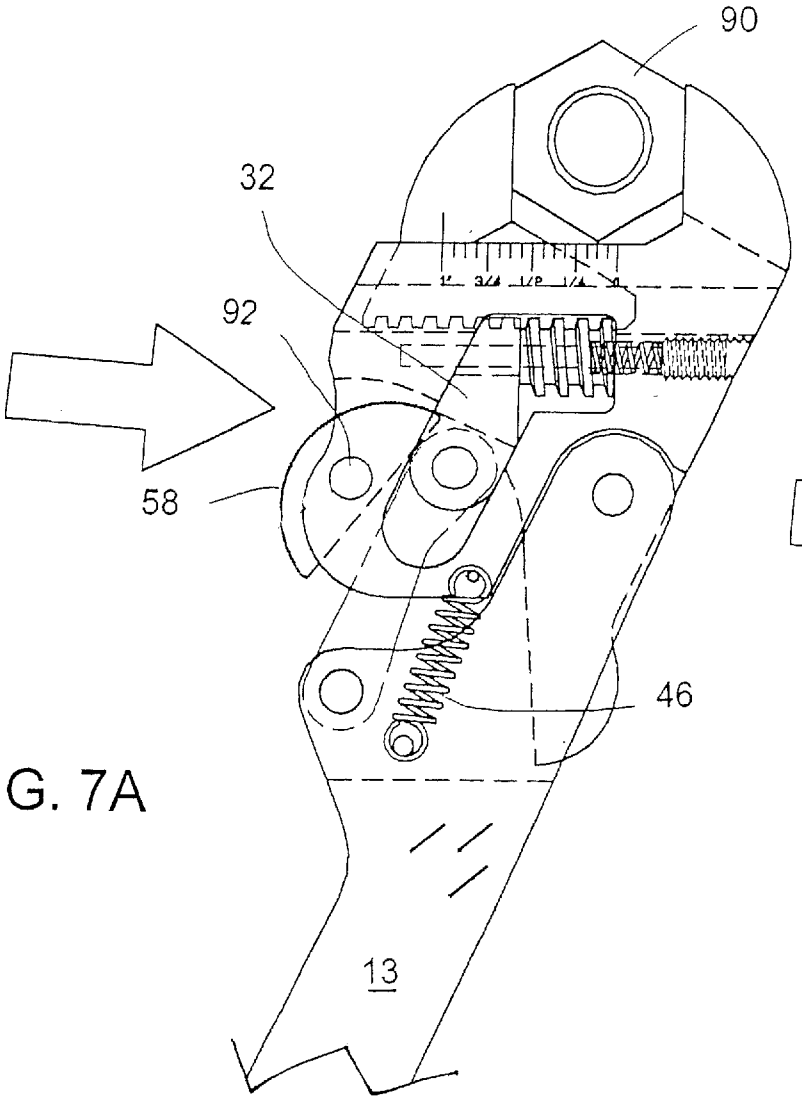

FIGS. 7A and 7B show a useful feature whereby the partial-circular knurled wheel or disc 58 can be mounted on a pivot 92 so as to be capable of rocking to two different positions, shown respectively in FIGS. 7A and 7B. In FIG. 7A the wheel section 58 is shown in a position to prevent retraction of the wedge 32, so that the jaws cannot separate regardless of the direction of movement of the wrench on the nut. In FIG. 7B the locking disc 58 is shown in the reverse-pivoted, normal release position which allows retraction of the wedge and thus ratcheting of the tool on the nut.

Figures 5A, 5B, 5C, 5D:
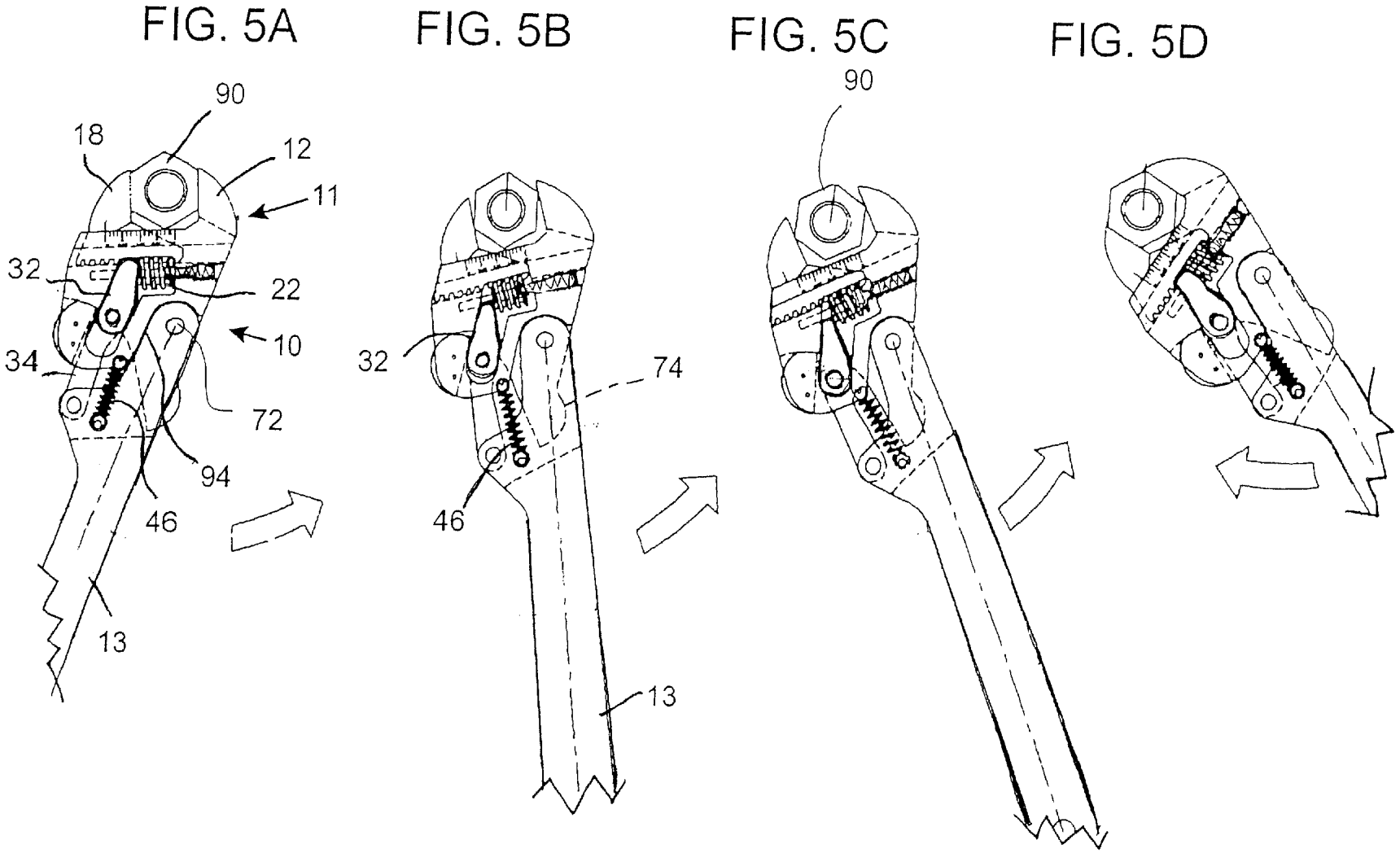
FIGS. 5A–5D are side elevation views showing progression of the wrench in slipping over a hexagon nut as the wrench ratchets to a new position for a new stroke of tightening the nut.

FIGS. 5A, 5B, 5C and 5D demonstrate the operation of the adjustable ratcheting wrench 10. The wrench is demonstrated as used on a hexagonal nut or bolt head, but it could be on a square nut or other shape of fastener having parallel facets. In FIG. 5A the tool has been placed on the nut 90 with the adjustment screw 22 adjusted to the appropriate nut size. FIG. 5A can be described as showing the position of the tool and nut after a stroke of nut tightening, in the clockwise direction as seen in the figures, has been completed. In this idle position pulls the head 11 of the tool relative to the handle, about the pivot point 72, toward the normal position wherein the head is nested close to the handle along the line 94 seen in FIG. 5A. The linkage arm 34 thus holds the wedge 32 at or near its maximum forward position, i.e. its fully supporting location for the adjustment screw 22, which is held in its uppermost position. However, if desired the wrench jaw separation can be adjusted so as to be nominally closer than the actual width of the nut 90. In this case the tool would be inserted over the nut by executing a slight head pivoting motion by contact with the nut, effective to swing the head back slightly against the force of the tension spring 46 so that the lower jaw spreads away from the fixed jaw 12 enough to accommodate the width of the nut. The knob or boss 74 can be used to spread the jaws. In this case the head would be angled back slightly in comparison to what is shown in FIG. 5, with the spring 46 stretched somewhat and with the wedge 32 retracted a small amount, but with considerable further contraction possible to accommodate ratcheting.

In FIG. 5B the wrench handle 13 has been pulled back, in the direction away from the lower jaw 18, as part of the arc of movement required to reset the wrench at a new position on the hex nut 90. The handle has been swung approximately 31° from the position shown in FIG. 5A, but the head 11 is caused to pivot back relative to the handle, against the force of the tension spring 46 as shown, so that it has rotated only about 15° from the original position. The wedge 32 is retracted somewhat, and now supports the adjustment screw (and along with it the lower jaw 18) at a displaced, lower position.

In FIG. 5C the wrench handle has been pulled back another approximately 20°, and the wrench head 11 is pivoted further relative to the handle. The wrench head has now rotated approximately 30° relative to its original position on the nut, while the wrench handle has been rotated a total of about 51°. As seen in FIG. 5C, this angle is sufficient to ride over the corners of the hex nut 90, so that the wrench can be moved to the position of FIG. 5D without opening the jaws any further. In FIG. 5D the wrench head has rotated to a full 60° as compared to the original position of FIG. 5A, but the handle and wrench head have returned to their original configuration shown in FIG. 5A. Thus, the handle has only undergone an additional 9° of rotation from its position in FIG. 5C. The wrench is now ready to be moved in the work direction, which is clockwise in these drawings.

All this time the adjustment screw spring 30 is pushing down on the adjustment screw 22, thus urging the jaw in the opening direction, but any such motion is limited by the presence of the wedge 32. This spring 30 does not play a particularly active role in the process just described, since the retraction of the wrench handle in itself will open the jaws by action of jaws against the faces and corners of the nut. However, the function of the spring is needed to spread the jaws open when the tool is used at a smaller setting than the targeted nut, such that the jaws need to be spread open as the tool is placed on the nut. This can be done by contacting a facet of the nut with the face of the fixed upper jaw 12 and then forcing the handle in a direction such that the head moves back on the pivot 72, but without the internal spring 30 the lower jaw would simply "float" in this situation, rather than opening as the head pivots.

The linkage member 34 is angled in such a way that the slightest movement of the handle in the work direction enhances the torque, such that a slipping of the nut inside the jaws is virtually impossible. The back force of the nut would have to overcome the enhancing force of the wedge (tending to hold or push the lower jaw upwardly). When moving the handle in the opposition, non-work direction, the wedge makes room for the adjustment screw to retract downwardly and therefore the jaws loosen their grip and the tool can be rotated around the nut almost effortlessly so that it can grasp the next sequential set of sides of the nut without having to be removed from the nut or bolt.

Figure 8:
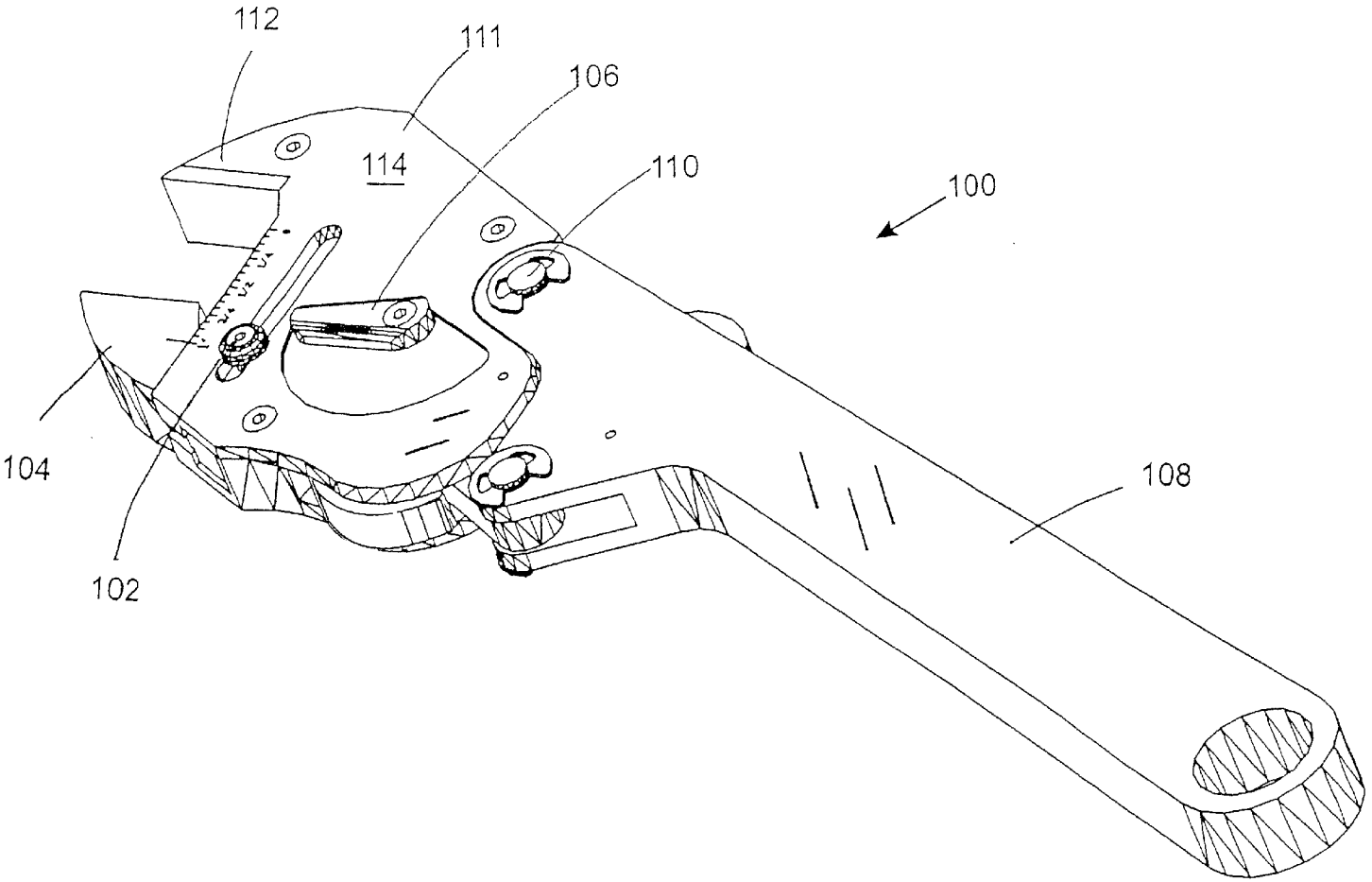
FIG. 8 is a perspective view showing a second form of adjustable ratcheting wrench according to the invention.
Figure 10:
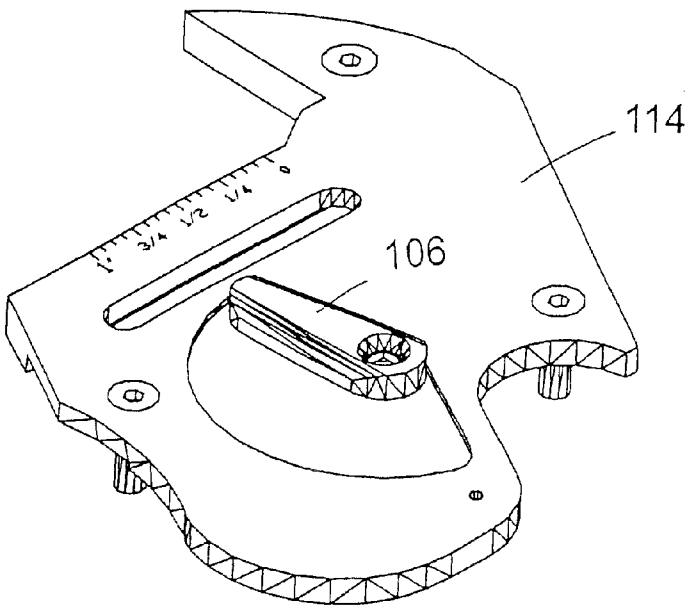
FIGS. 9 and 10 are perspective views showing components of the wrench of FIG. 8.

FIGS. 8–17 show another form of adjustable ratcheting wrench 100 according to this invention. The wrench 100 is in principle very similar to the wrench 10 described above, but without an adjustment screw. Instead, the tool is adjustable by sliding a knob 102 upwardly or downwardly as seen in FIG. 8, which moves the lower jaw 104 accordingly. This can be accomplished only when a jaw adjustment lever 106 is rotated to its opposite extreme position from that shown in FIG. 8, i.e. in the counterclockwise direction from FIG. 8, demonstrated in FIGS. 8–15. The tool 100 includes a handle 108 similar to that of the previous embodiment, connected at a pivot pin 110 to a tool head 111, which is comprised of more components than the tool head 11 of the previously described tool. The head 111 includes an upper or fixed jaw 112, against which the lower jaw 104 works to engage a nut or bolt.

Figure 9:
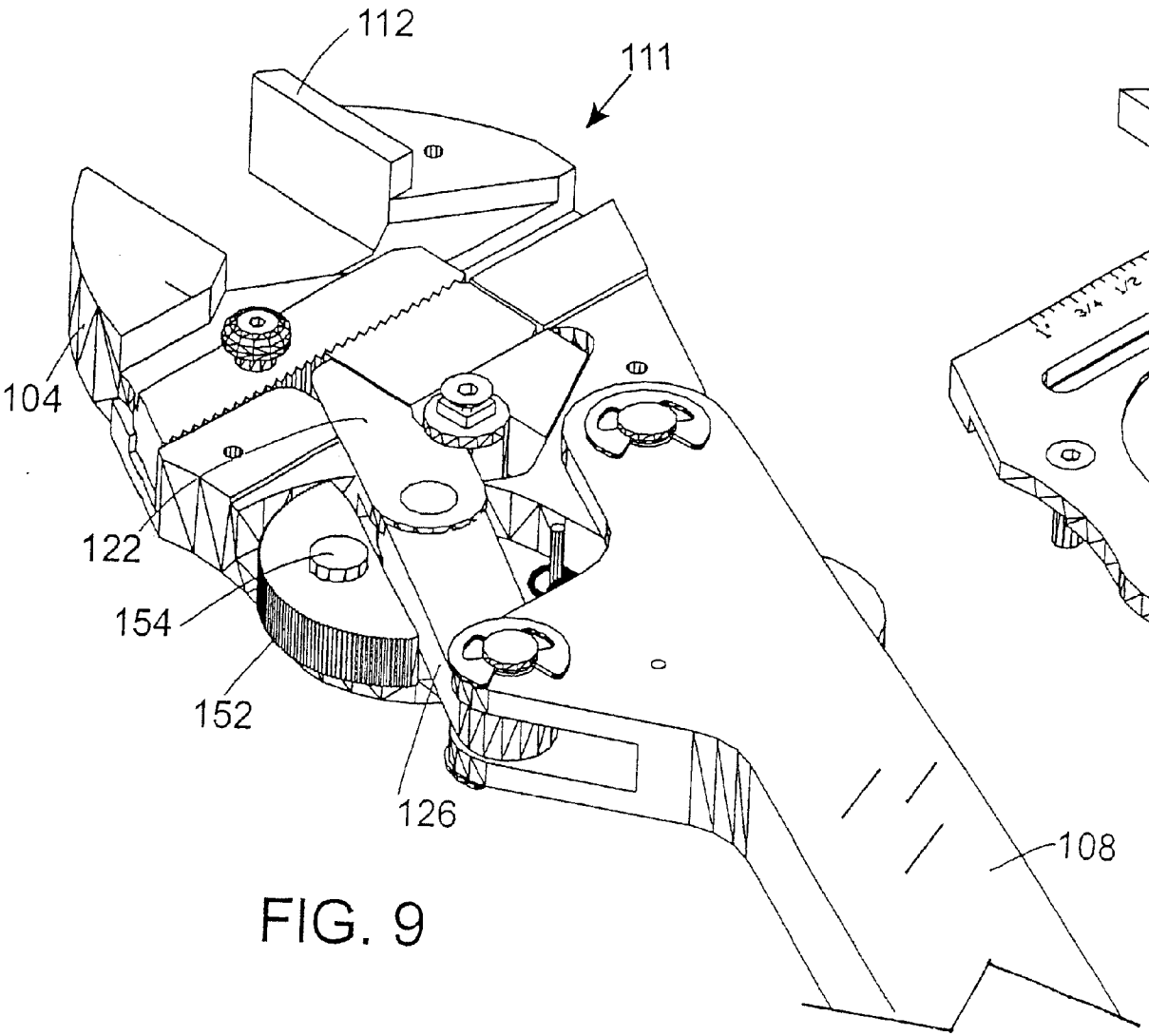
Figure 11:
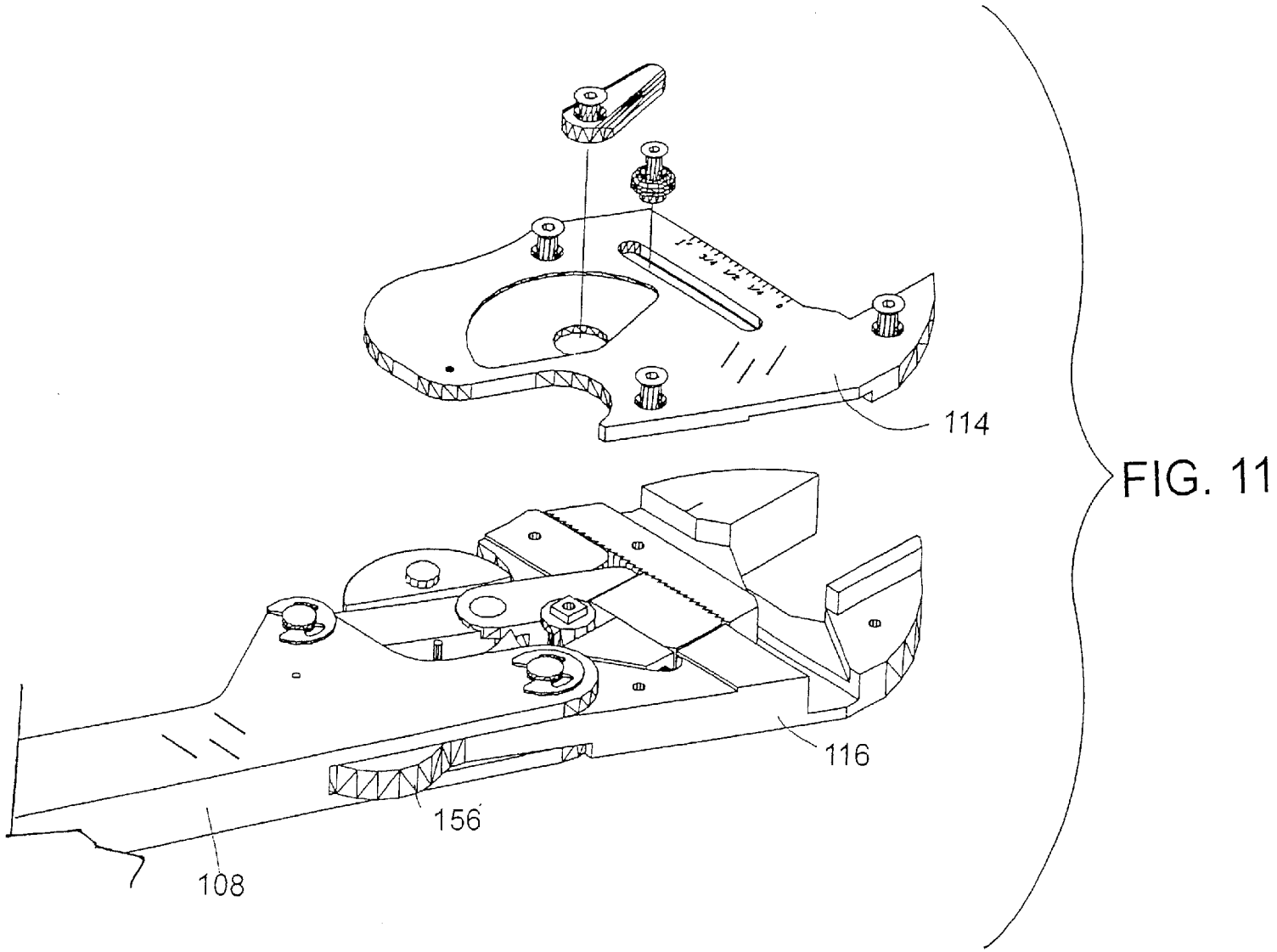
FIG. 11 is a perspective exploded view showing the same wrench.
Figure 12:
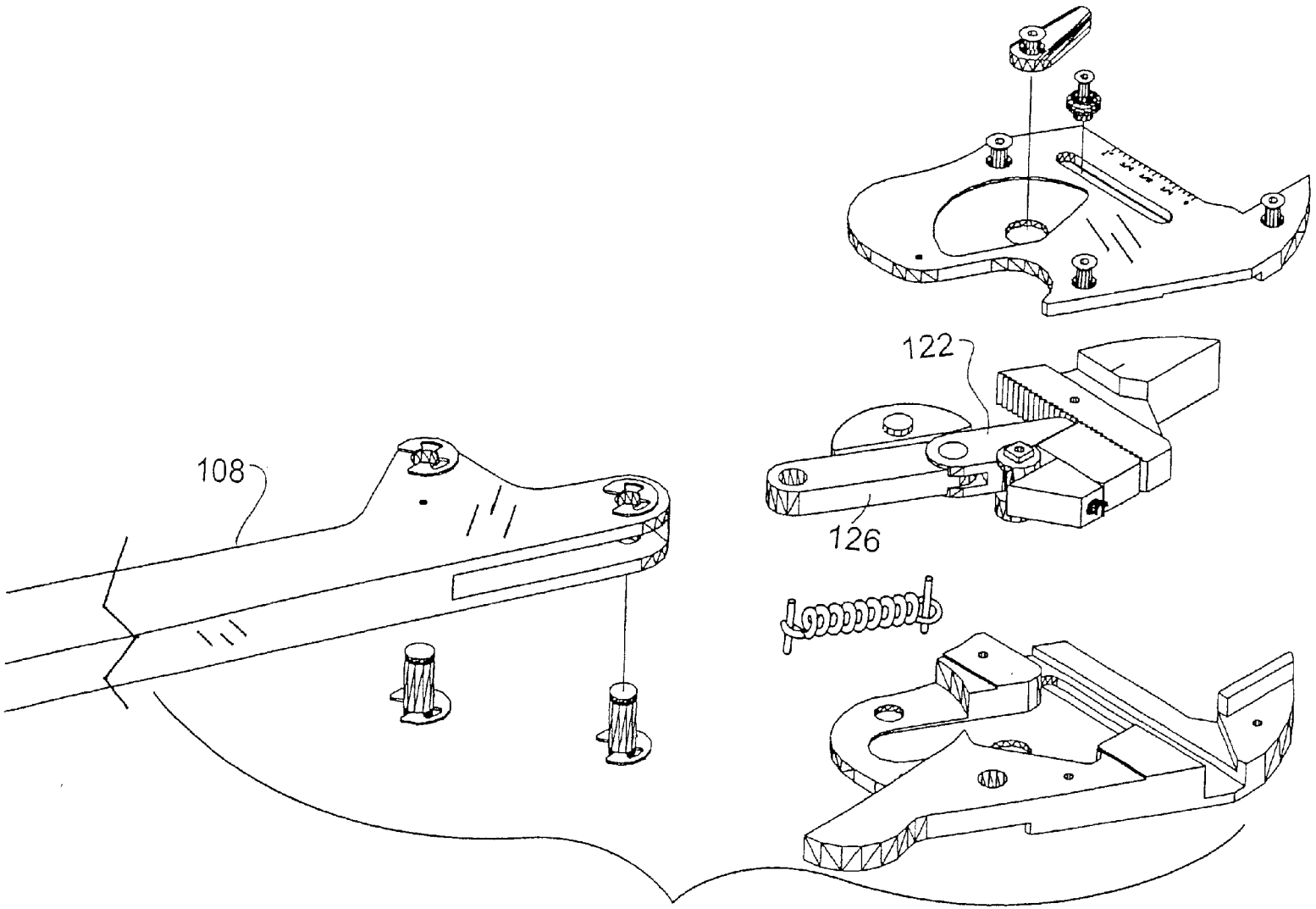
FIG. 12 is another exploded view of the wrench.
Figure 13:
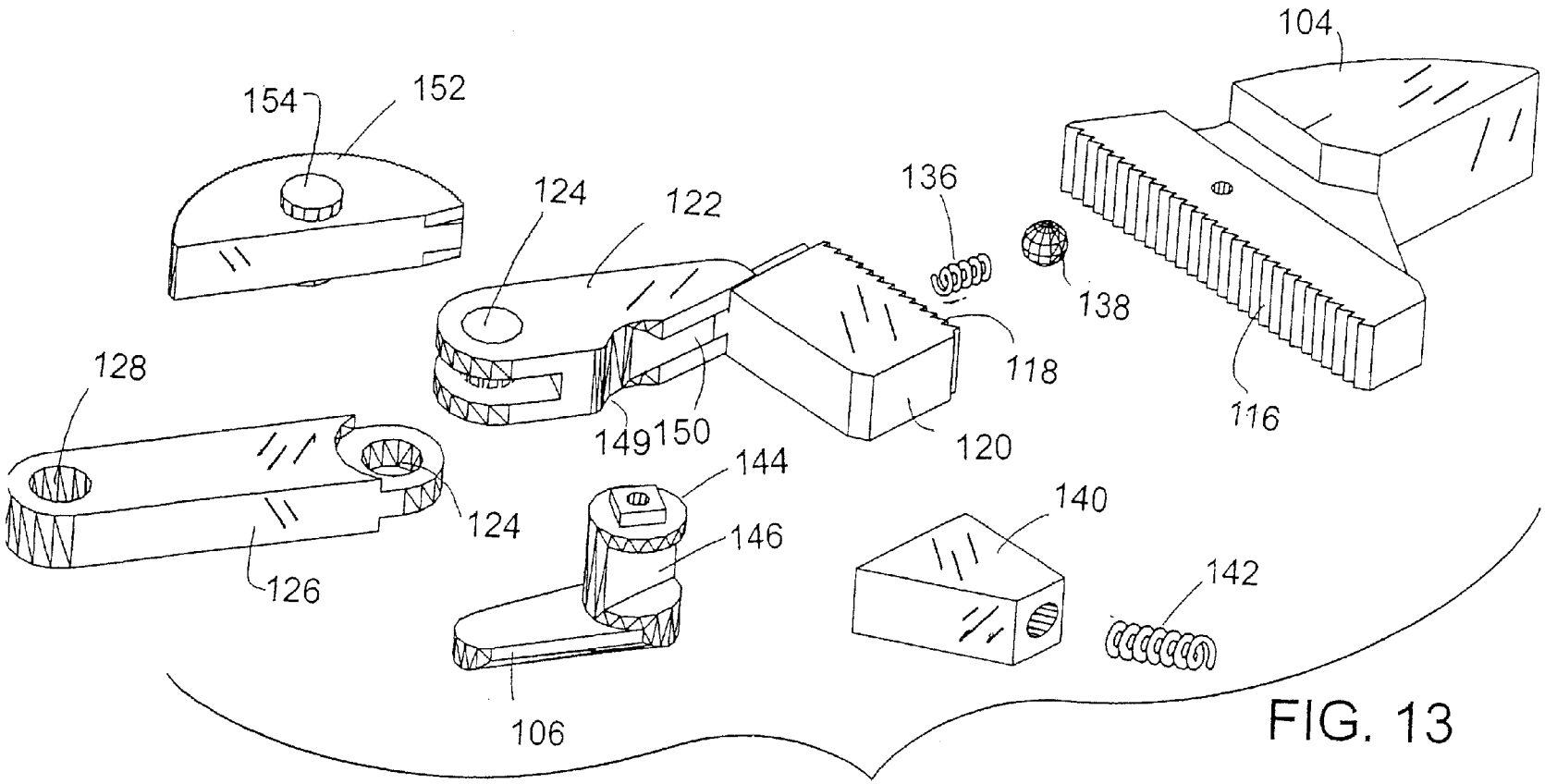
FIG. 13 is an exploded perspective view showing certain components of the head of the wrench.

As seen in these drawings, the tool head 111 includes an outer plate 114 and a base portion 116 within which several components reside. The lower jaw 104 has, preferably as an integral extension, a rack of teeth 116, and these are positioned to engage and interlock with a corresponding rack of teeth 118 on a tooth block 120. The lower edge of this block 120, as seen in the drawings, is supported by a slidable wedge 122, which functions in the same manner as the wedge of the earlier embodiment. The wedge 122 is connected at a pivot point 124 to a linkage arm 126, which is in turn connected at a pivot point 128 to an extension 130 of the wrench handle 108, at another pivot point 132. A tension spring 134 urges the handle and head toward the "normal" position, such as shown in FIGS. 8 and 9.

Figure 14:
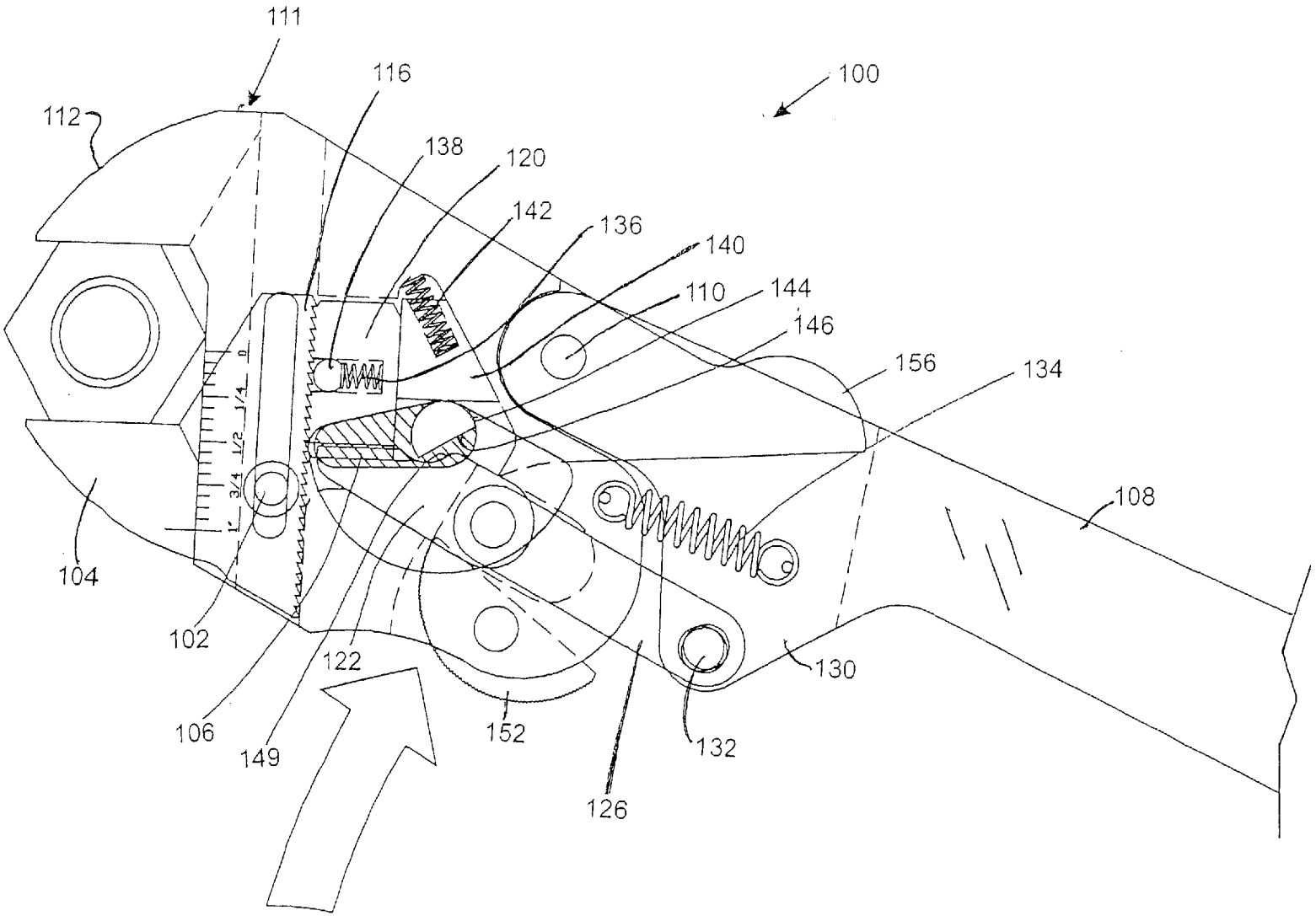
FIG. 14 is a side view of the wrench, showing several features.

The tooth block 120 is spring-biased away from the rack of teeth 116 on the lower jaw, by a compression spring 136, which bears via a ball 138 directly against the rack of teeth 116. As seen in FIG. 14, the spring 136 and ball 138 are seated within a recess of the block 120.

In addition, a second wedge 140 is provided in the wrench head. This wedge 140 is urged by another compression spring 142 in a retracting direction, downward and to the right as viewed in FIG. 14. When the jaw adjustment lever 106 is in the locked position as shown in FIGS. 8, 9, 11 and 14, with a flattened cylindrical barrel 144 turned such that its flat 146 is away from the bottom end of the second wedge 140, the second wedge is locked in place in its upper position, by which it forces the tooth block 120 to its position of interlocked engagement with the lower jaw's rack of teeth 116. In this "normal" condition of the tool, the jaw will be fixed at a certain setting, but back rotation of the tool handle 108, away from the lower jaw 104, will of course retract the wedge 122, the same as with the tool 10 described above, thus allowing the lower jaw to move away from the fixed jaw and allowing ratcheting of the tool around a nut or bolt in the non-work direction.

Figure 15:
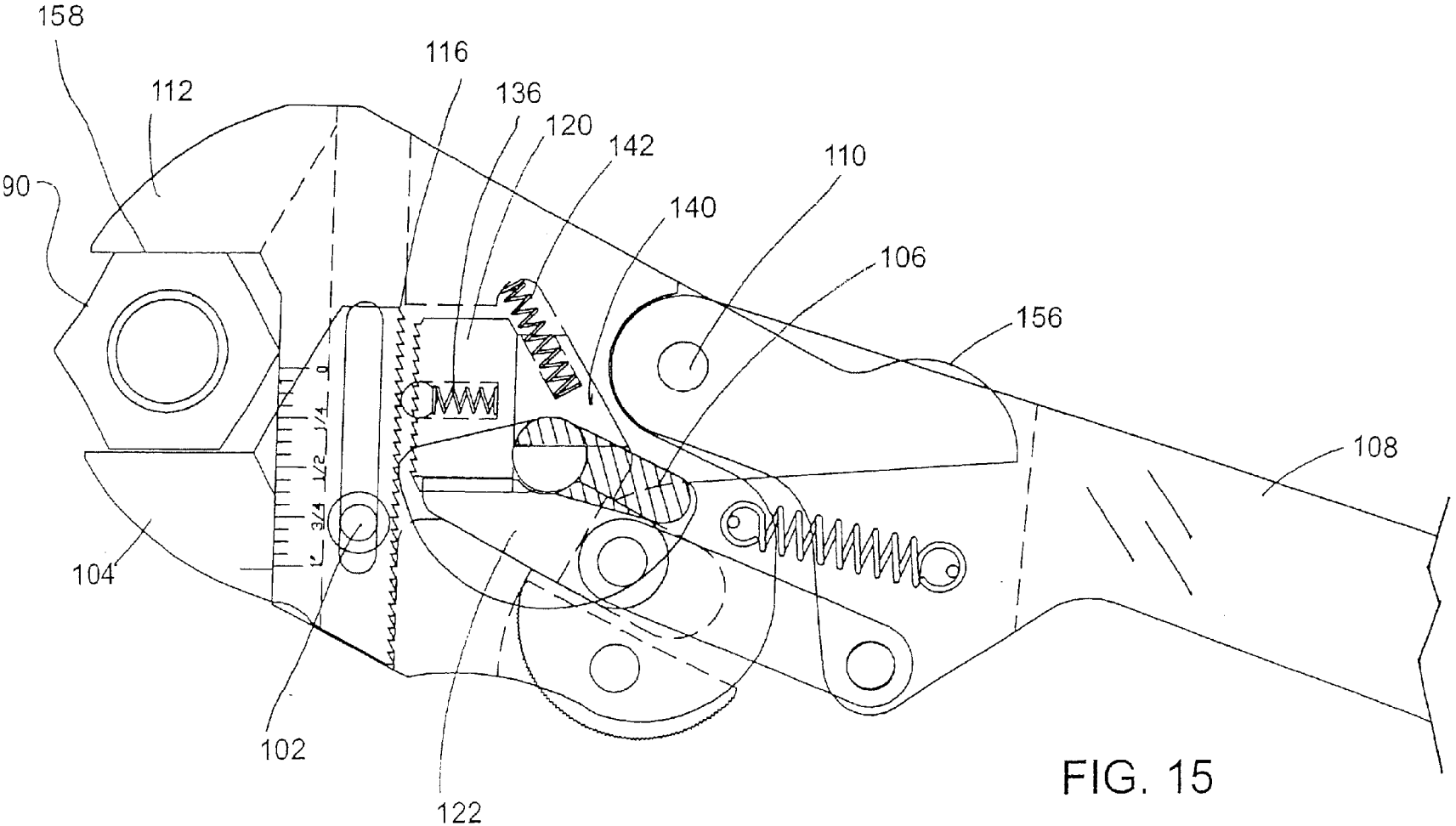
FIG. 15 is another side view of the wrench, shown in a different position.

To adjust the tool 100 to a nut size, the user first rotates the lever 106, counterclockwise as seen in FIGS. 8–15, to its jaw adjustment position shown in FIG. 15. This rotates the internal barrel 144 to the position such that its flat 146 is turned to the upward position as seen in FIG. 15. See also FIG. 13 for a detailed view of this component, secured at one side to one of the two adjustment levers 106 (the other of which is secured after assembly of the tool). FIG. 15 shows that this allows the second wedge 140 to slide downwardly and to the right under the influence of its compression spring 142, and the tooth block 120 moves to the right as seen in FIG. 15, due to its spring 136 and the space created by the movement of the second wedge 140. The sets of teeth 116 and 118 have now been separated, allowing the user to slide the lower jaw 104 up or down, using the adjustment knob 102 (preferably one provided at each side of the tool). When the lower jaw is moved, the user feels "click-click-click" because of the ball 138 which continues to bear against the teeth of the rack 116. These teeth may be in 1/16th inch increments, thus accommodating typical English nut and bolt sizes, but other increments can also be used. This jaw adjustment can be done with the tool on the nut.

When the user feels and hears the last click as the lower jaw is moved into contact with the facet of a nut, the jaws will be close to touching both parallel facets of the nut. Note that, as can be seen in FIG. 15, the main wedge 122 moves down and retracts as the tooth block 120 backs away from the jaw teeth 116. This is because when the adjustment lever 106 is rotated to the adjustment position (counterclockwise), its flat 146 engages a recess 149 (see FIGS. 14 and 15), which pushes the wedge 122 back a small distance. The main wedge 122 is connected to the block 120 via a dovetail groove 150 or other similar connection, and thus the movement of the wedge 122 causes the tooth block to move slightly downwardly as seen in FIG. 15 as it disengages from the jaw teeth. This is preferable for re-engaging, so that the teeth cannot end up tip on tip. The slight retraction of the wedge 122 also causes the tool handle 108 to pivot back a few degrees, as seen in FIG. 15.

The drawings show that a knurled knob 152 can be included on the tool 100, as discussed above concerning the other tool, secured on a pivot 154 and shiftable to two different positions, one of which is shown in FIG. 14 and one in FIG. 15. If the knob is shifted to position in FIG. 14, using a thumb or finger to push it in the clockwise direction, it will lock the wedge 122 in position, preventing retraction of this wedge for the situation in which the user wants to use the tool for work in both directions.

The figures show a thumb engagement knob or boss 156 at the upper end of the handle. See particularly FIG. 11. This is rigidly connected to or integral with the base portion of the tool head, and enables the user by pressure with the thumb, to shift the relative angular position of the head and handle, thus effectively backing the handle away slightly from the lower jaw and opening the lower jaw (assuming the knob 152 is not in the locked position). This is helpful in placing the wrench over a nut 90, since the tool is conveniently used by setting the jaws slightly closer than the actual size of the nut, as described above in connection with the tool 10. Either the upper jaw 112 can be placed against a facet 158 of the nut, and the handle pressed in such a way that the head is moved to an angle about the pivot 110, or the thumb knob 156 can be used to open the jaws.

Figure 15A:
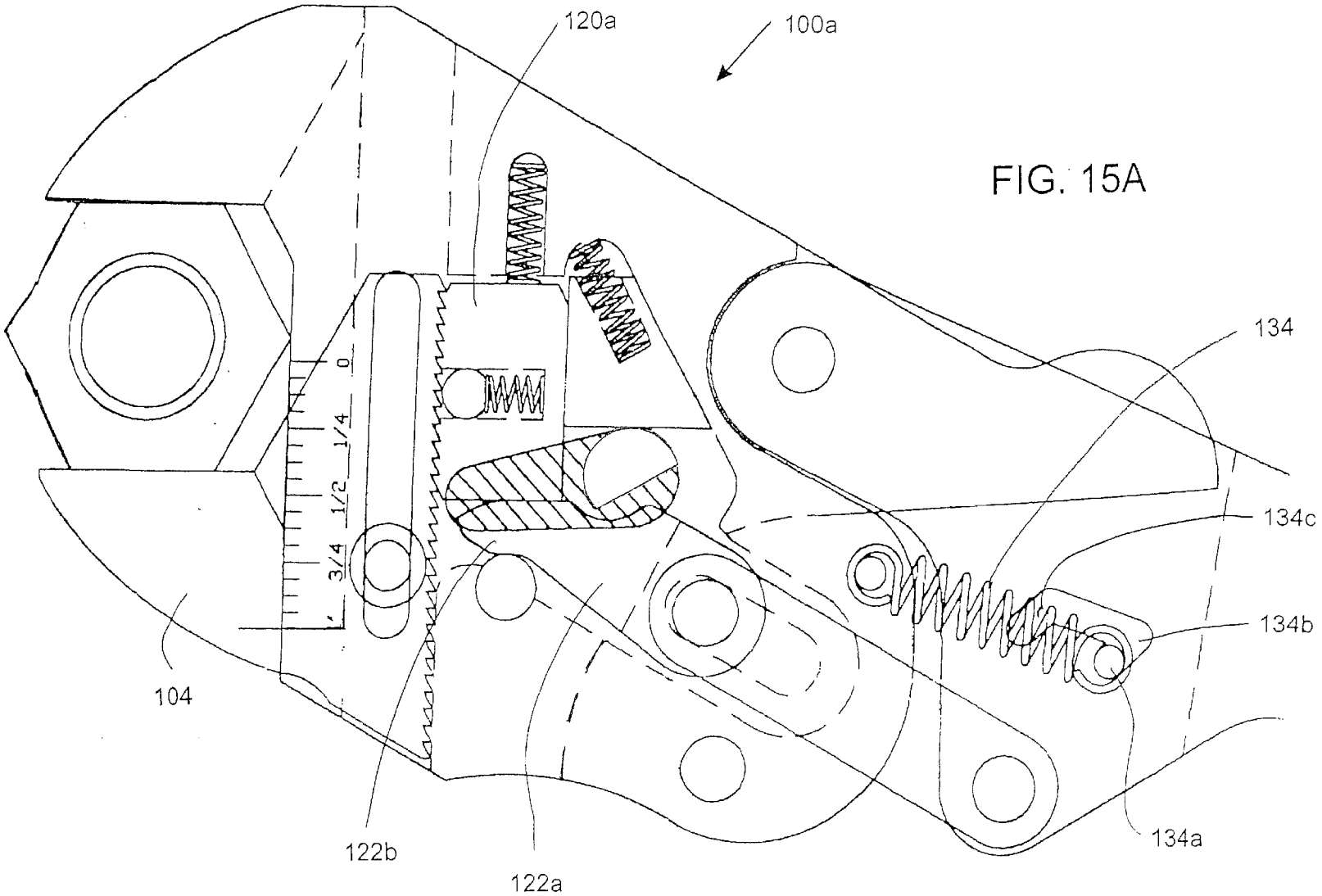
FIGS. 15A and 15B show a modified form of the wrench of FIG. 15.
Figure 15B:
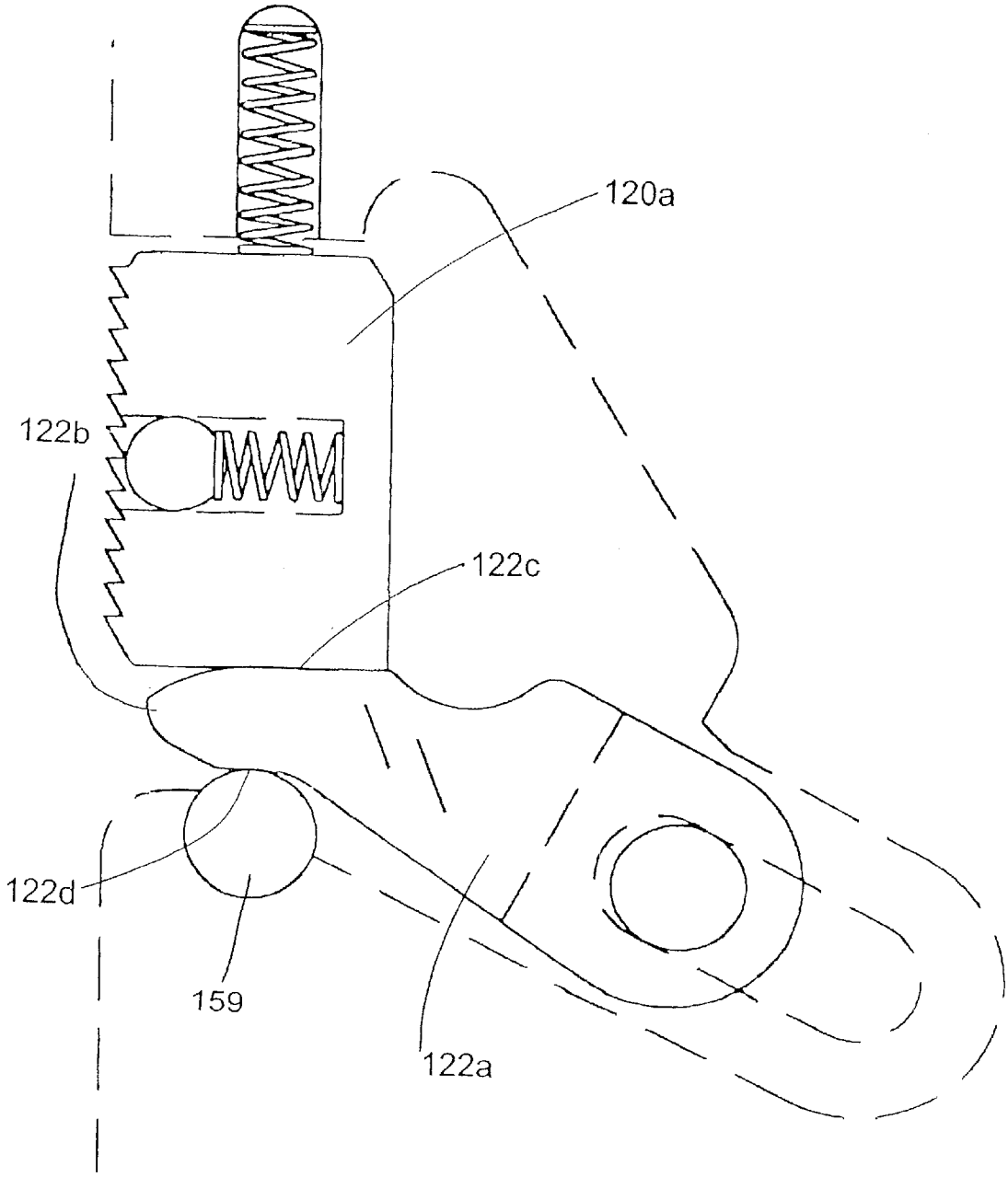

In FIGS. 15A and 15B, a variation of the wrench 100 is shown. The modified wrench 100*a* provides a reduced wedge angle for the wedge 122*a* which is effective to minimize the chance of the wedge being pushed back by the reaction force of a small nut, which when tight can exert a great opening force on the lower jaw 104 and, through the tooth block 120*a*, downwardly on the wedge 122, tending to retract it. In the modified wedge 122*a*, the wedge has a narrow end 122*b* defining only a very small angle between its upper and lower faces 122*c* and 122*d* as shown in FIG. 15B, and this small angle may be about 3°. A steel pin 159 or other rigid surface preferably is provided below the lower angled face 122*d* of the wedge. In this form of wedge, the active surfaces 122*c* and 122*d* supporting the tooth block 120*a* could be parallel, so that no jaw reactive force will be tending to push the wedge back, but a small amount of angle is preferred in order always to assure a positive grip on slightly varying nut sizes. If needed, the steel pin 159 could easily be replaced when worn out. The pin 159 could also be replaced by a slightly larger roller bearing.

FIG. 15A shows another variation in the wrench 100*a*. The retention of the tension spring 134 can be via a movable pin 134*a* which resides in a slot 134*b*. The spring 134 preferably is not exposed to the exterior of the tool, but the ends of the pin 134*a* are exposed. As FIG. 15A indicates, this pin 134*a* can be moved to two different positions—the positions shown, in one end of the slot 134*b*, and a closer position at an opposite end 134*c* of the slot. These two different settings are useful to adjust spring tension to a lower tension when a nut or bolt is too tight to rotate by hand (without the wrench), but too loose to force the jaws open when the wrench is moved in the non-work ratcheting direction.

Figure 17:
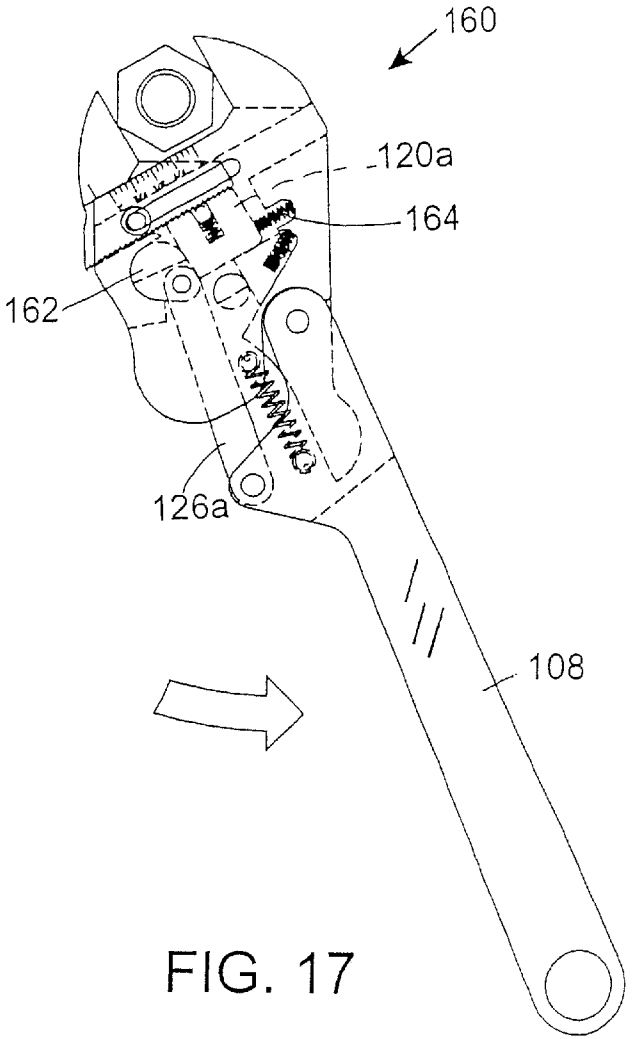
FIGS. 16, 17 and 18 are side views of the wrench and a detail of the wrench, showing a variation wherein a cam replaces a sliding wedge.
Figure 18:
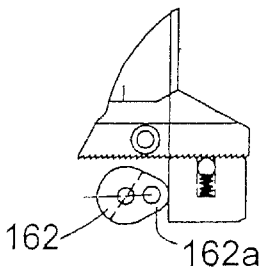
Figure 16:
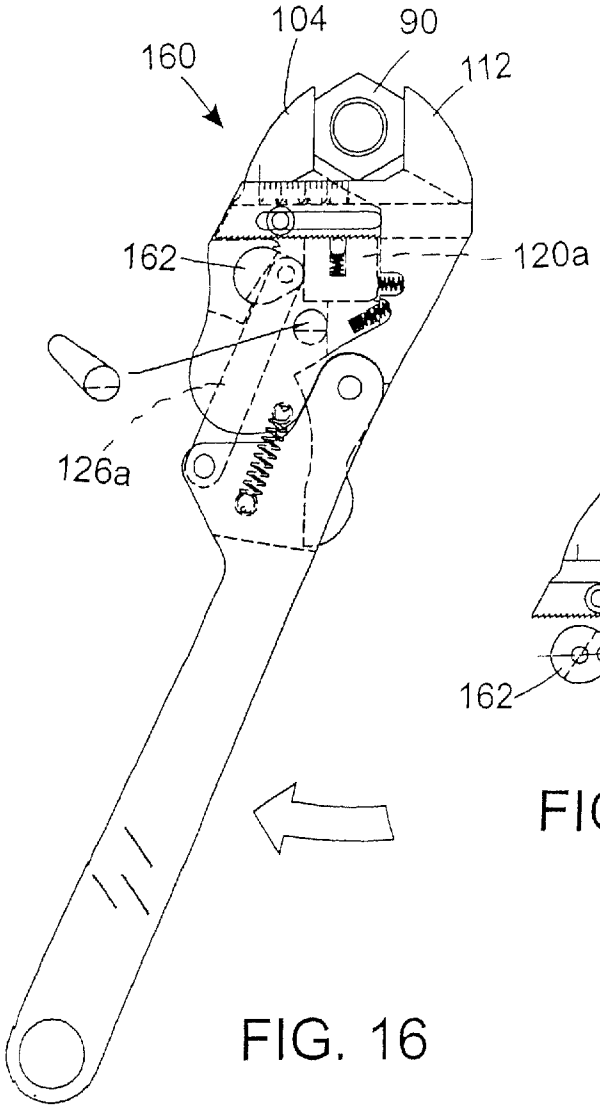

FIGS. 16–18 show a variation of the wrench just described. In this version, the wrench 160 is primarily the same in operation but has a cam 162 rather the wedge 122. A linkage arm 126*a* extends from the wrench to the tip end 162*a* of the cam 162, as shown. The linkage 126*a* could be eliminated if desired, with the cam member 162 driven by a direct connection with the wrench handle, i.e. an extension thereof (not shown). In the normal position of the wrench, such as shown in FIG. 16, wherein the wrench can be used in the clockwise work direction to operate on the nut 90, the cam is held by the linkage member 126*a* in the "dead point" position shown, also illustrated in FIG. 18. Here, the cam holds the tooth block 120*a* in its uppermost position possible, locking the tool's lower, adjustable jaw 104 in position. However, when the wrench handle 108 is pulled back, away from the lower jaw as shown in FIG. 17, the linkage arm 126 goes into tension and pulls the tip end 162*a* of the cam, rotating it in the clockwise direction as shown. This allows the tooth block 120*a* to be lowered, under the influence of a compression spring 164, which in effect replaces the dovetail connection described above between the tooth block 120 and the wedge 122. Thus, the lower jaw opens with the retraction of the handle 108, and the wrench works in a manner similar to that described above.

Figure 19:
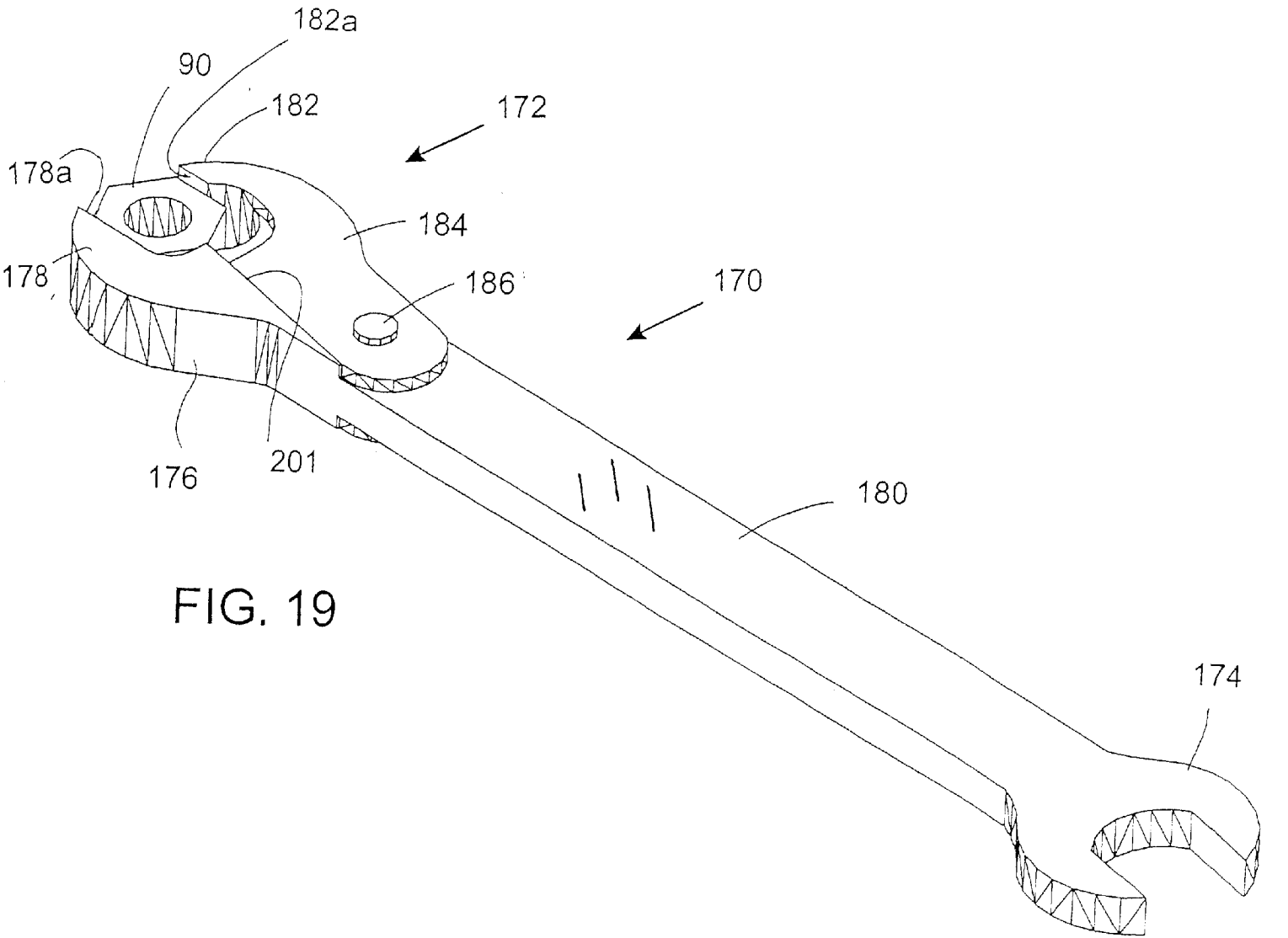
FIG. 19 is a perspective view showing another form of the invention, in this case a non-adjustable open-end ratcheting wrench.
Figure 20:
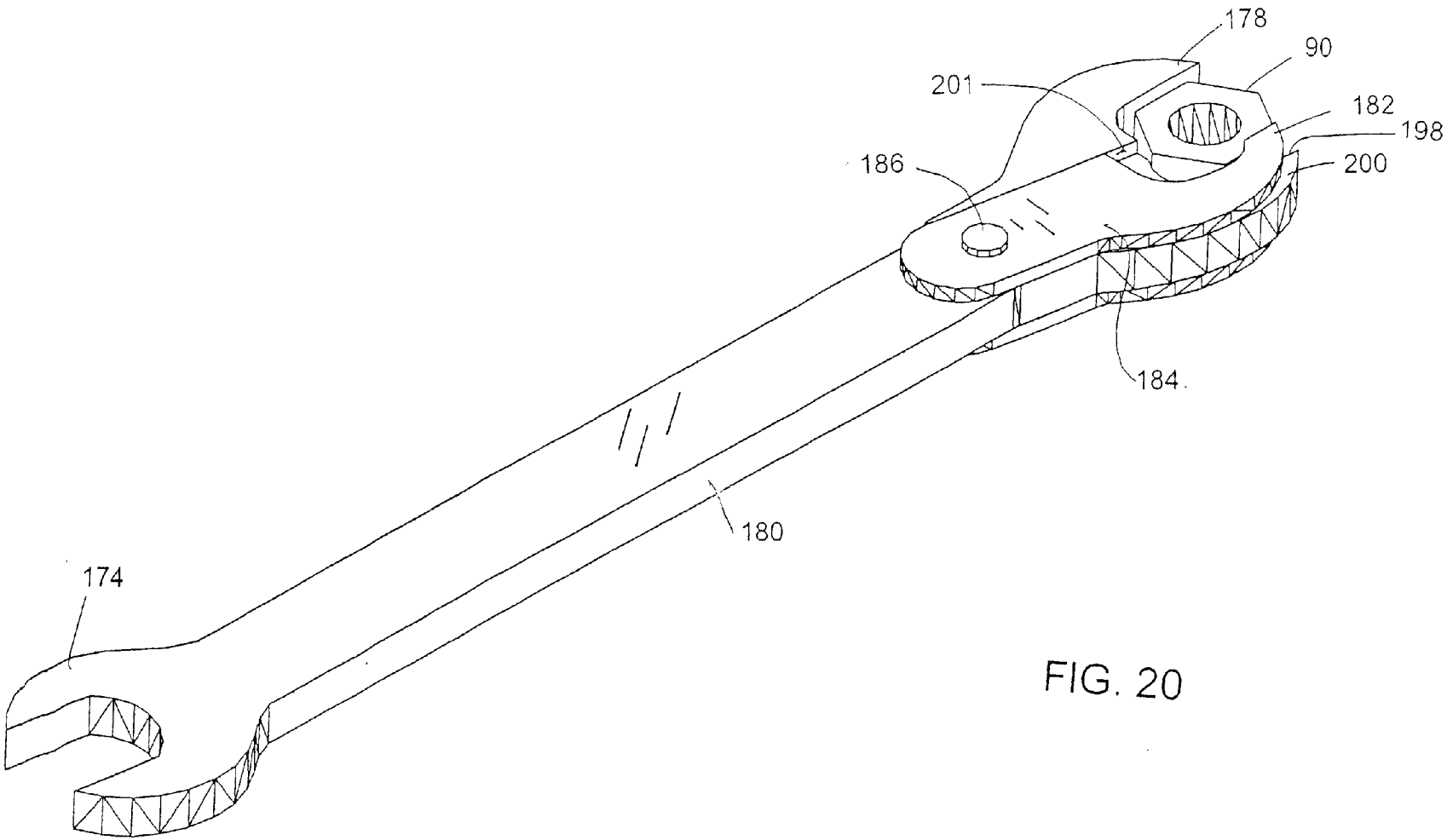
FIG. 20 is another perspective view of the wrench.
Figure 21:
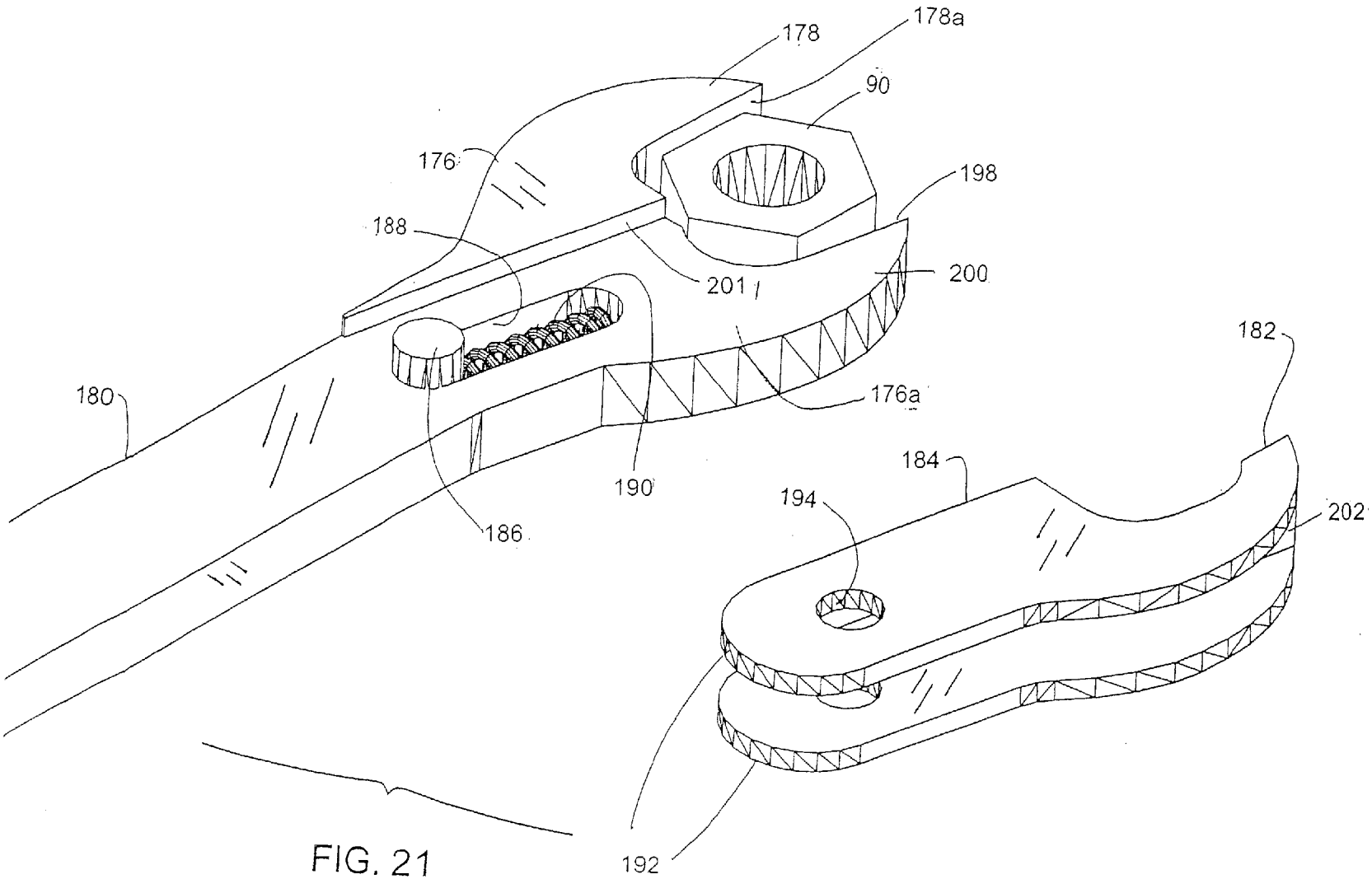
FIG. 21 is an exploded perspective view showing components of the wrench.
Figure 22:
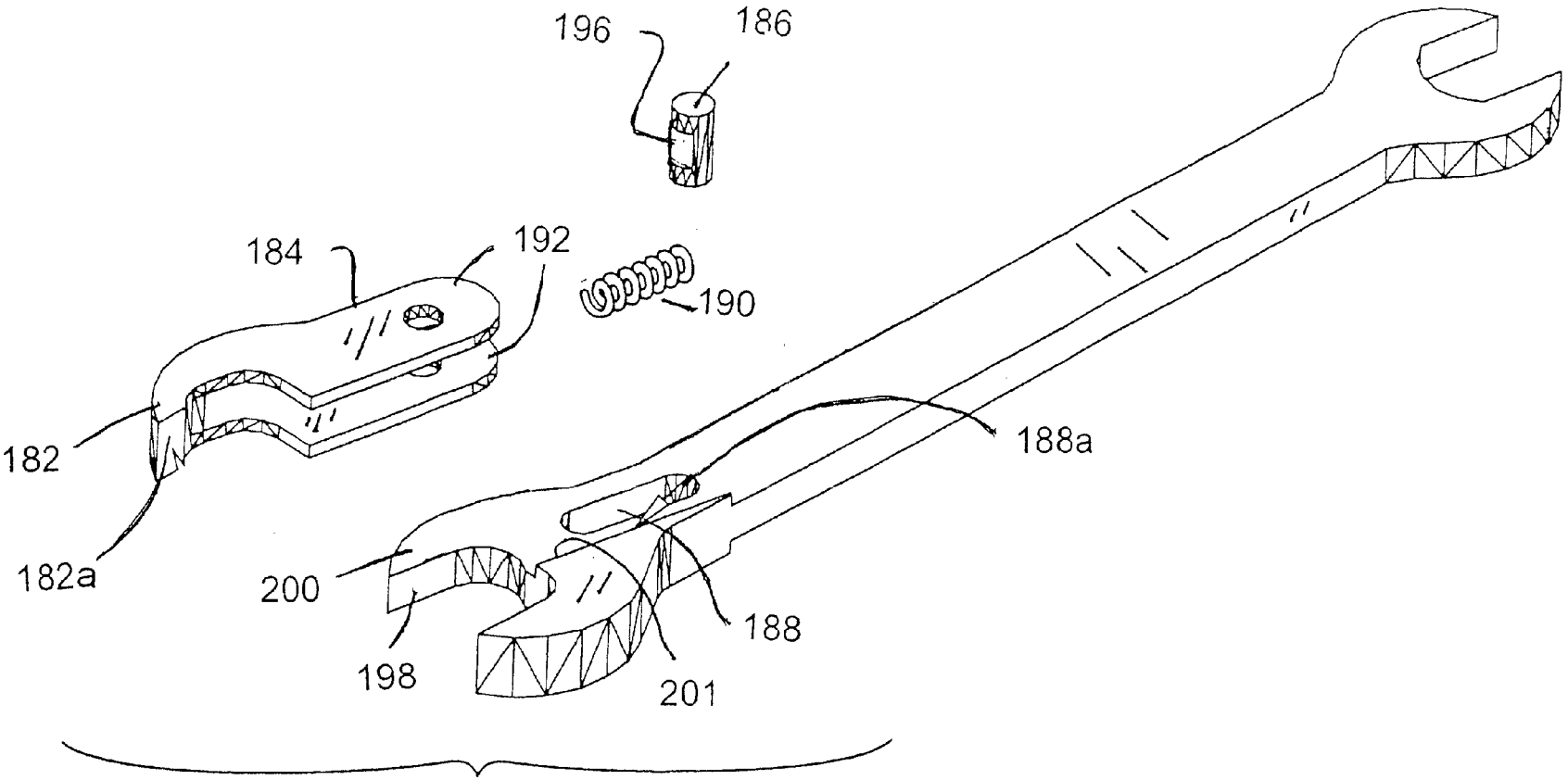
FIG. 22 is another exploded perspective view of the wrench.

FIGS. 19–25B show another form of ratcheting wrench according to the invention, in this case an essentially non-adjustable open-end wrench. In FIG. 19 the wrench 170 is shown engaged on a nut 90, with a ratcheting end 172 of the wrench. As shown, the opposite end 174 of the wrench can be formed as a simple open-end wrench, of the same nominal size as the ratcheting end or of a different size.

FIGS. 19–22 show the relatively simple construction of this ratcheting wrench 170. A wrench head 176 with a fixed jaw 178 is integral with a wrench handle 180. The fixed jaw is positioned to engage flatly against a facet of a nut or bolt 90. The wrench also has a movable jaw 182, formed on a separate, slidable component 184. As shown, the jaw component 184 is secured to the wrench handle and head via a pin 186, mounted slidably in a slot 188 in the handle. A compression spring 190 urges the pin, and the jaw component 184 secured to the pin, in the direction down toward the handle, i.e. to the lower right in FIG. 19 and to the left in FIGS. 20 and 21. Assembly of the forked jaw component 184 is understood with reference to FIG. 22; the two flanges 192 of the forked jaw component are fitted over a reduced-width portion 176*a* of the wrench head, from the outer end of the wrench, and then slid down until the two holes 194 of the flanges 192 are over the slot 188, with the spring inside the slot. To put the pin 186 in place the spring 190 can be compressed by using a special tool comprising a similar-diameter pin (not shown) with a sharply angled end, to wedge the spring over and make room for the pin 186, inserted axially in stacked position on the tool, thus pushing the tool out, seating the pin between the spring and the bottom end 188*a* of the slot 188. The pin 186 has a flat 196 turned toward the spring to engage its end, thus capturing the pin from falling out. Some form of seat may be provided at the opposite end of the slot 188, i.e. toward the jaws of the wrench, but this is not necessary because the two flanges 192 of the jaw component 184 will close the sides of the slot and prevent the spring from escaping.

The jaw component 184 has a wedge forming the outer end 182, and this slides along an inner face 198 of a fixed and angled jaw guide 200 integral with the wrench head and handle. It can be seen from FIGS. 19–22 that the wedge, a portion of which is seen at 202 in FIG. 21, slips behind the jaw guide 200, such that the surface 202 rides along the jaw guide face 198. The jaw guide face is angled outwardly relative to the opposing face 178*a* of the opposite jaw, making an angle of about 10° to 12°, preferably 10° or less, away from parallelism with the opposite jaw face 178*a*. The wedge 182, 202 is complementarily shaped, so that the movable jaw face 182*a* is established as parallel to or substantially parallel to the opposite jaw face 178*a*. This movable jaw face 182*a*, as can be seen in the drawings, makes a contact with the nut face which is less than a full facet contact.

The compression spring 190 (which could be a tension spring in a slightly different arrangement) allows the movable jaw component 184 to slide outwardly relative to the wrench head and handle when forced in that direction, guided by the wedge face 202 sliding along the jaw guide face 198 and by the pin 186 riding in the slot 188. Guiding is also made by a ledge 201 on each side where the wrench head drops in thickness, with the jaw member 182 moving along this ledge. The ledge 201, the slot 188 and the jaw guide face 198 preferably are all parallel. As the jaws open, the movable jaw face 182*a* remains parallel to the fixed jaw face.

The jaw component 184 can be pushed outwardly by a user's thumb, or it will automatically slide forward, increasing the separation between jaws, whenever the wrench is moved in a clockwise direction as viewed in these drawings. This is demonstrated in FIGS. 23A–25B.

Figures 23A, 23B, 23C, 23D, 23E, 23F, 23G:
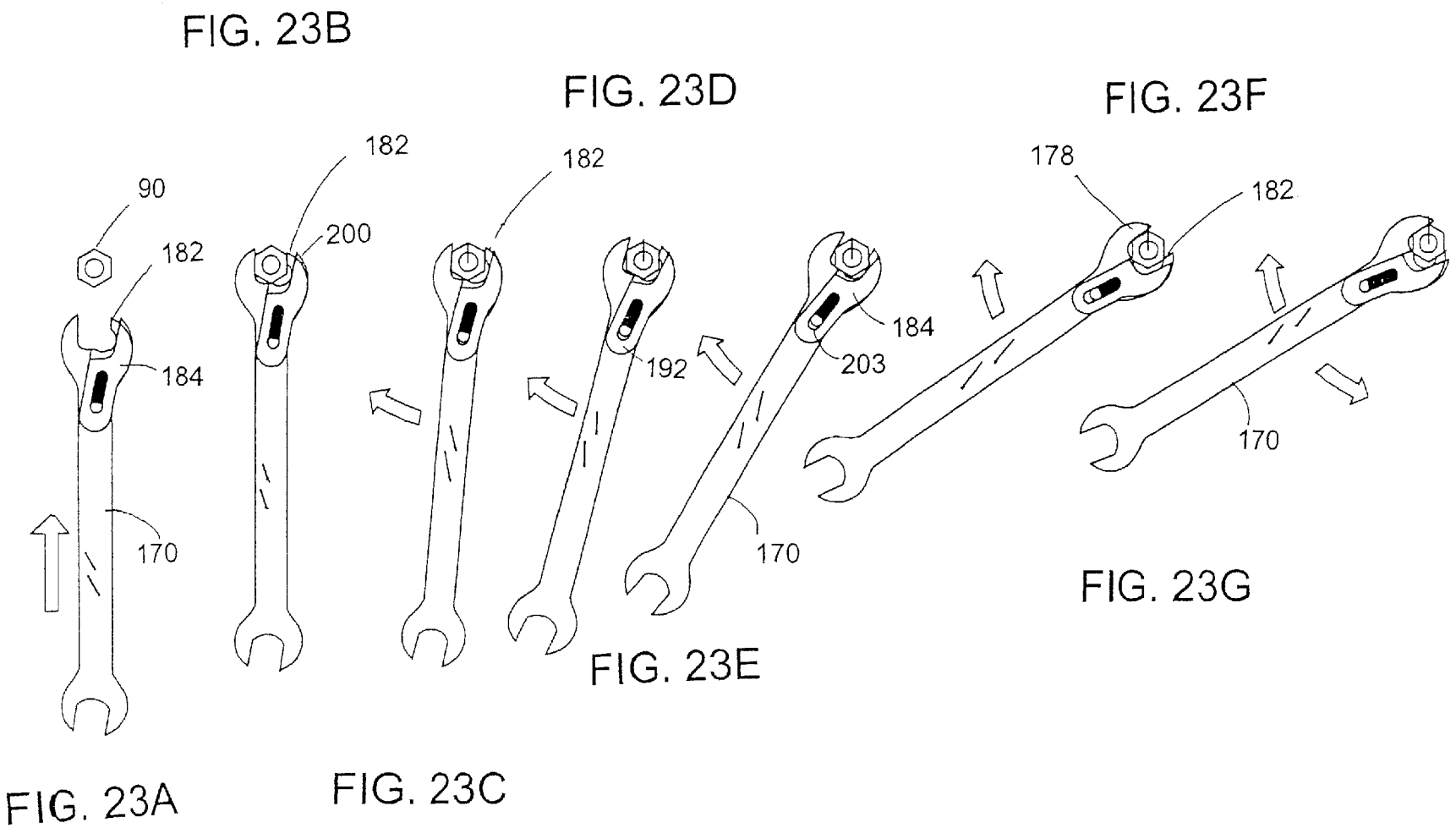
FIGS. 23A–23G are schematic views showing successive positions of the wrench as the wrench is ratcheted over the facets of a nut.

In FIGS. 23A–23G the wrench is shown schematically, with the slot 188 and spring 190 revealed, even though these components are not visible through the movable jaw component 184. FIG. 23A shows the wrench 170 ready to be placed on the nut 90. FIG. 23B shows the wrench in place. FIGS. 23C–23G show the wrench being rotated in the clockwise, non-work direction, through 60° of rotation until the wrench engages the next set of opposed facets of the hexagonal nut. In FIG. 23C the wrench has been rotated about 5°, and in FIG. 23D, about 15°. The sliding jaw 182 becomes angled in its engagement against the nut's facet as shown, and this clockwise rotation of the tool causes the sliding jaw to pull outwardly along its sliding path. This is represented in the drawings by indication of a small crescent-shaped space 203, which is actually beneath the surface of the sliding jaw 184, i.e. between its flanges 192, indicating the forward movement of the pin 186 in the wrench's slot 188.

In FIG. 23F the wrench 170 has been rotated approximately 55°, and the sliding jaw member 184 is at about a maximum extension within the slot 188 for this nut 90, prior to the wrench's being properly located for the next pair of nut facets. As shown, the sliding jaw 182 still rides on the original nut facet, but is near one of the apices of the nut. In this position the jaws 178 and 182 of the tool are at about maximum separation needed for this nut, thus when the full 60° of rotation is completed, as in FIG. 23G, the slidable jaw 182 readily slides back under the influence of the spring pressure, to again grip the nut closely between the jaws 178 and 182. The jaw 182 slides back in a direction of motion which is parallel to and defined by the jaw guide surface 198, along a line obliquely divergent from the opposite jaw face 178*a*, as discussed above. It is this oblique direction of travel which widens the spacing between the jaws as the movable jaw member 184 extends outwardly, even though the two jaws have faces which always remain approximately parallel.

Figure 24C:
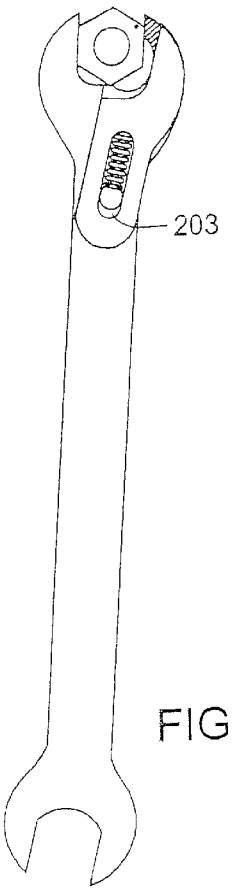
FIGS. 24A–24C are views showing that the wrench can accommodate a range of nut or bolt sizes.
Figure 24B:
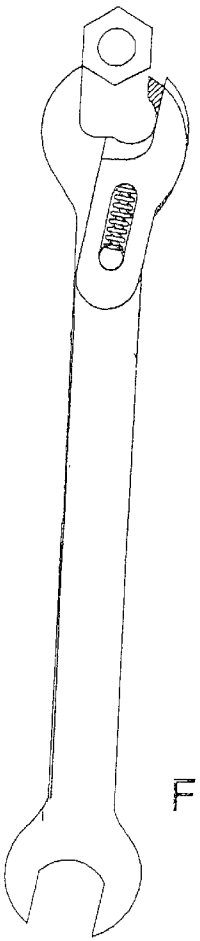
Figure 24A:
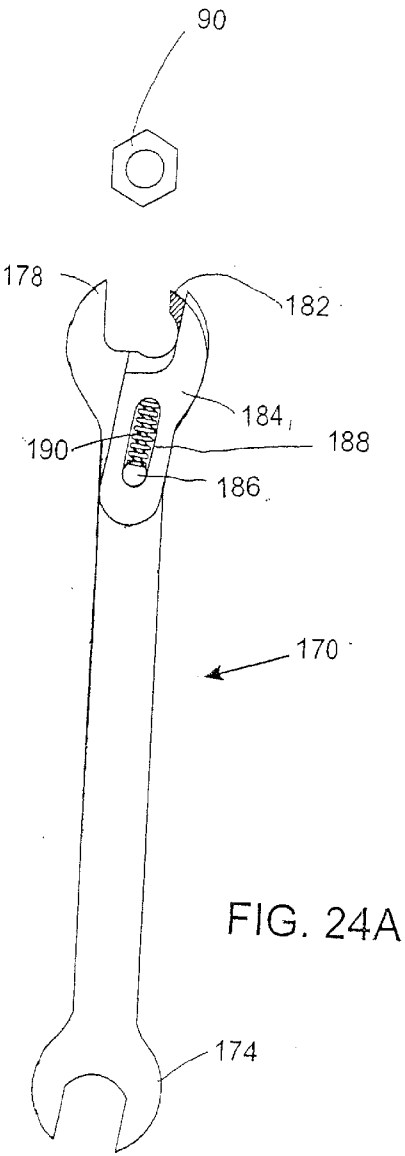

FIGS. 24A–24C demonstrate that the wrench 170 can have an actual jaw separation which is slightly less than the width between facets of a nut 90. In the example of FIG. 24A, the nut is a one-half inch nut, while the tool's jaws 178 and 182 are spaced apart, in the normal and relaxed position, about 0.002 inch less, for example. FIGS. 24A–24C also illustrate that a nominal one-half inch wrench will also fit a metric 13 mm nut. To open the jaws slightly to engage either the half-inch nut or the 13 mm nut, one simply pushes outwardly on the movable jaw member 184, or against the pin 186. Again, as in the previous drawings, the spring 190 within the tool is seen in this schematic drawing, as is the slot 188, whereas these components are actually not visible.

The outward sliding of the movable jaw member 184 opens the spacing between the jaws and enables a nut, which may be within a range of sizes, to be gripped by the tool as shown in FIG. 24C.

Figure 25B:
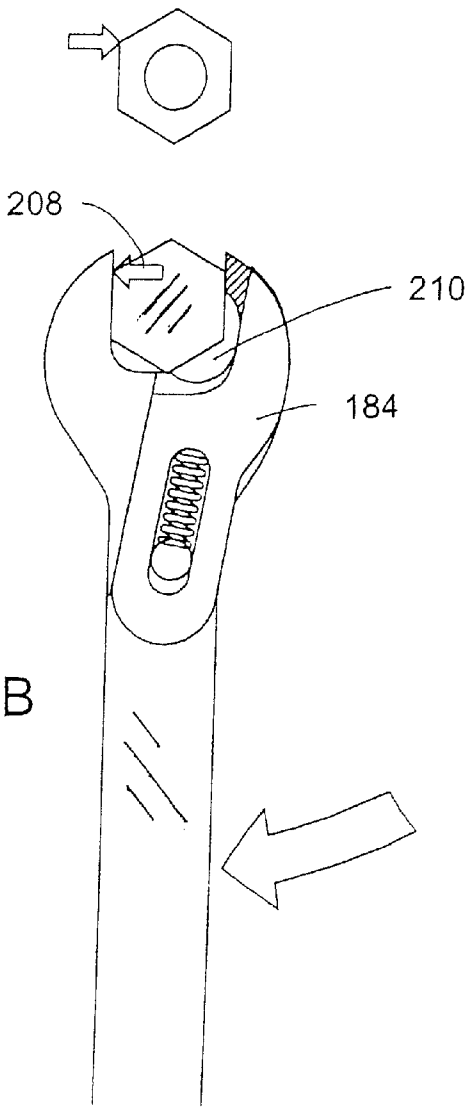
FIGS. 25A and 25B are companion views demonstrating the manner in which the wrench operates.
Figure 25A:
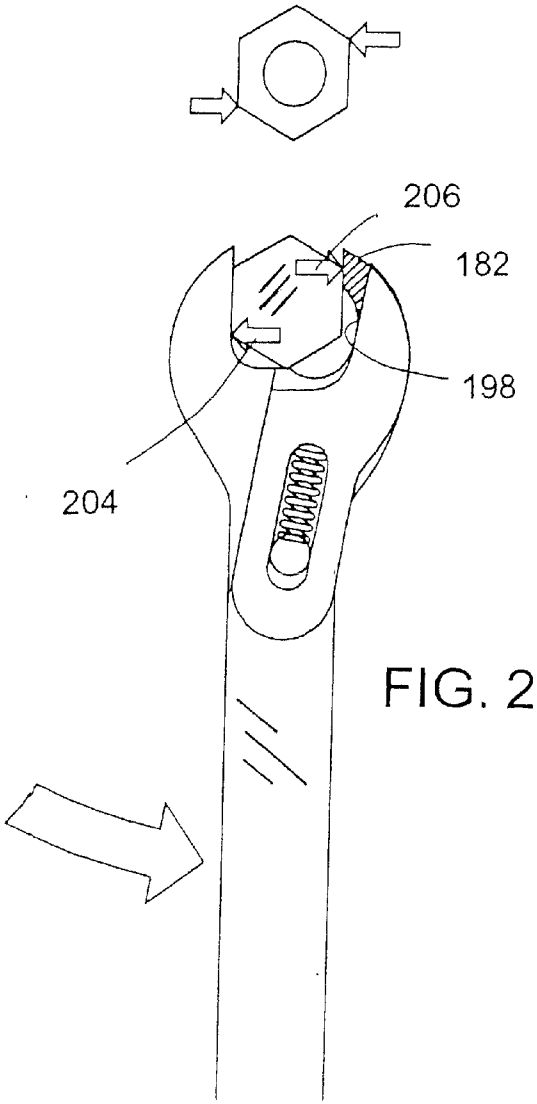

FIGS. 25A and 25B demonstrate forces acting on the nut and reacting against the tool when the tool is used in the work direction (counterclockwise in FIG. 25A), and in the non-work, ratcheting direction (clockwise as in FIG. 25B). In the work direction, the reaction force points are shown by arrows 204 and 206, each force point being at or in the immediate vicinity of an apex at the edge of the nut facet. This is the same manner in which an ordinary open-end wrench exerts force on a hexagon or square nut, and thus the lack of greater apparent contact area for the slidable jaw 182 is not of any consequence. In this form of wrench, where rotation of the handle in the direction toward the movable jaw performs work on the nut, the degree of oblique angulation of the jaw guide face 198 is very important. The reaction force arrow 206 shows that this force has a component tending to slide the jaw 182 outwardly on the guide surface 198, and if the angle were large enough this would happen. A combination of spring force and friction prevent it, provided the angle is small enough, preferably up to about 10° to 12°, and most preferably about 10° or less.

When the wrench is rotated in a non-work direction, as in FIG. 25B, a slight reaction force is exerted on the nut as shown by the arrow 208. On the other side of the nut the movable jaw 182 tends to slide back slightly on the nut facet (down in FIG. 25B), but begins sliding outwardly on the wrench head as described above. A recess or pocket 210 is left on the side of the movable jaw member, to receive the apices of the nut and to receive one entire facet of the nut during a portion of the ratcheting, as can be seen in FIGS. 23A–G. The outward sliding of the movable jaw member 184 provides more room for the tool to rotate around the nut or bolt during this ratcheting operation.

Figure 26:
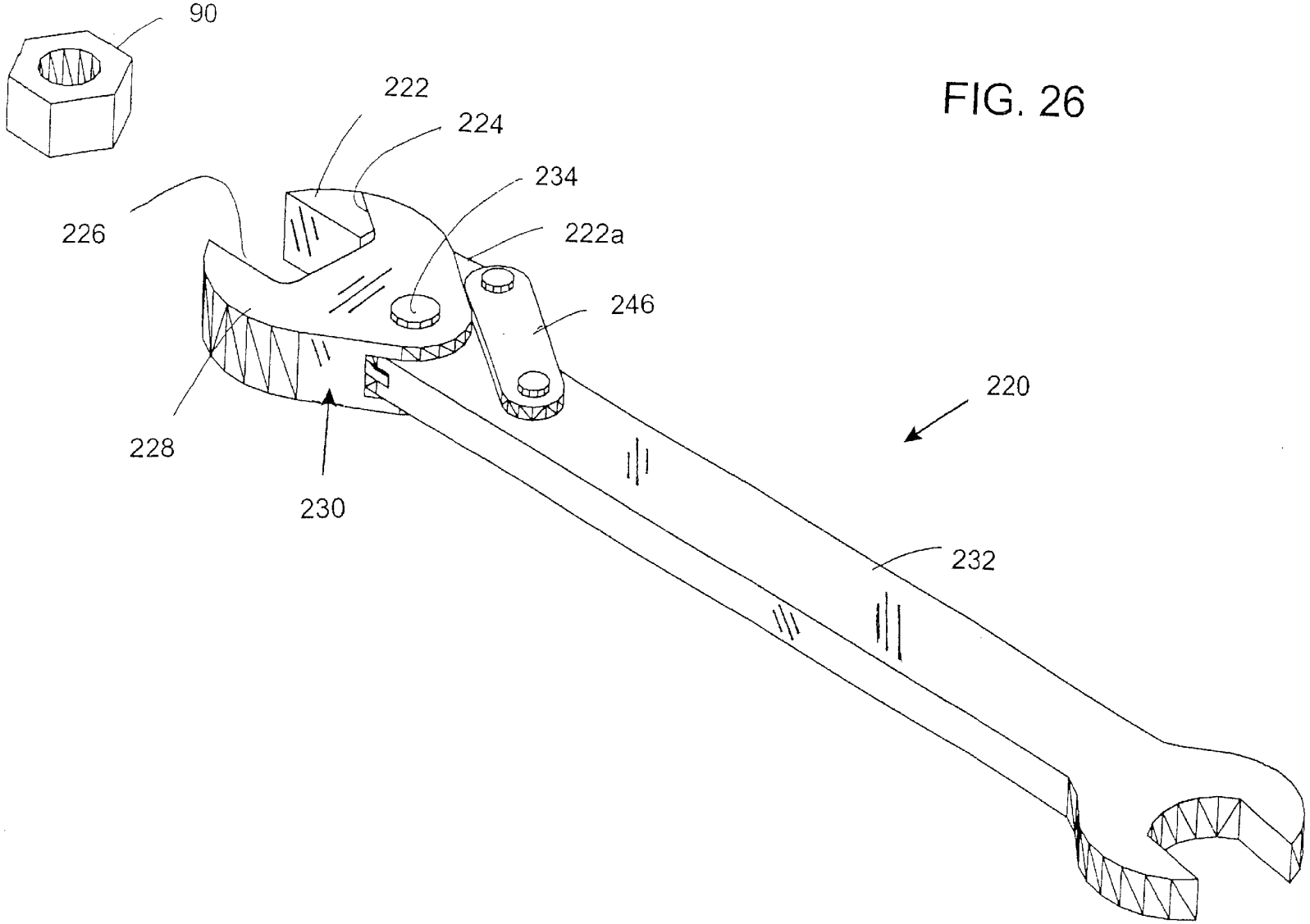
FIG. 26 is a perspective view showing another form of an open-end non-adjustable ratcheting wrench, operating on a slightly different principle from the wrench of FIGS. 19–25.

FIG. 26 shows another form of ratcheting, non-adjustable open-end wrench 220 according to the invention. In this form of wrench, the principle of operation is similar to the previously described form, in that a movable jaw member 222 is slidable along a plane 224 which is obliquely angled outwardly with respect to the opposite, fixed jaw face 226, on the fixed jaw 228. However, the wrench 220 operates differently in that, in the counterclockwise direction of rotation as the wrench is seen in FIGS. 26, 27, 29, 30A–B, and 31A–D, where the wrench is rotated toward the slidable jaw, the slidable jaw 222 slides outwardly on the plane 224 and allows the wrench to slip or ratchet over the nut 90, rather than gripping and performing work on the nut as in the previously described open-end wrench.

In this case, the wrench head 230 pivots with respect to the wrench handle 232, about a pivot pin 234. The head is biased in the direction counterclockwise relative to the handle as seen in these drawings by a coil spring 236 seen in FIGS. 28 and 29. In other words, the handle is spring-biased in the direction away from the movable jaw. FIG. 29 indicates that the coil spring 236, which acts in torsion, urges the head to swing in the direction of the arrow 238, and this forces the movable jaw 222, which comprises a wedge, in the direction of the arrow 240, which is parallel to the sliding plane 224. The limit of this sliding back movement of the wedge 222 is established by the gripping of the nut 90. Without the nut in position, the tool is preferably constructed so that the wedge will retract a slight additional distance under the force of the torsion spring 236, defining a jaw clearance slightly less than the nominal nut size for which the tool is intended. Thus, a small clearance 242 is left between the back side of the wedge 222 and the back wall 224 of the tool's nut gripping recess defined between the jaws.

Figure 27:
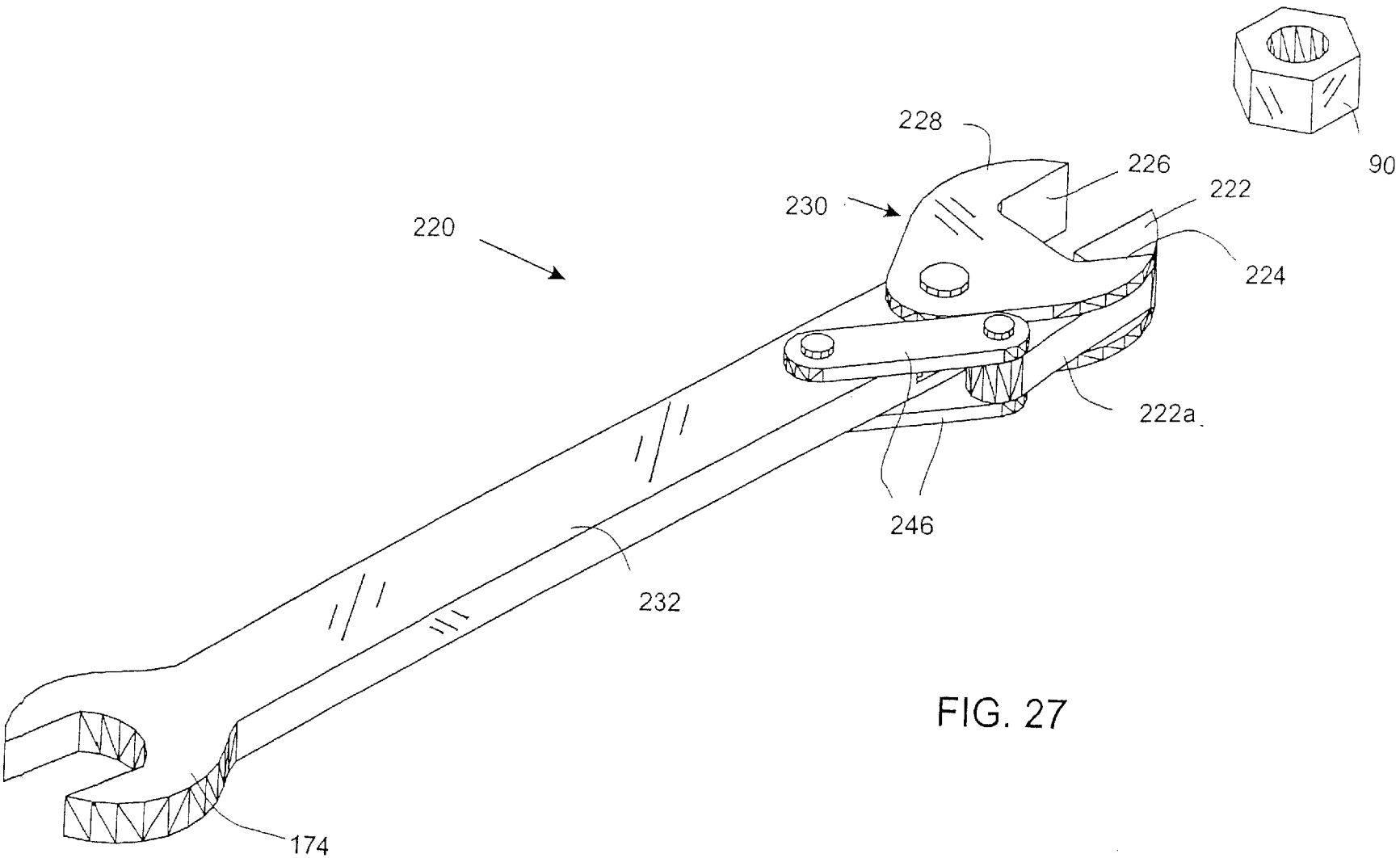
FIG. 27 is another perspective view of the wrench FIG. 26.

The retraction of the movable jaw wedge 222 is effected by a linkage arm 246, connected to the wrench handle at a pivot 248 and to the movable jaw member 222*a*, of which the jaw wedge 222 forms a part, by another pivot 250. As seen in FIG. 27, the linkage arm 246 can comprise a pair of arms, one on each side of the handle 232.

Figure 28:
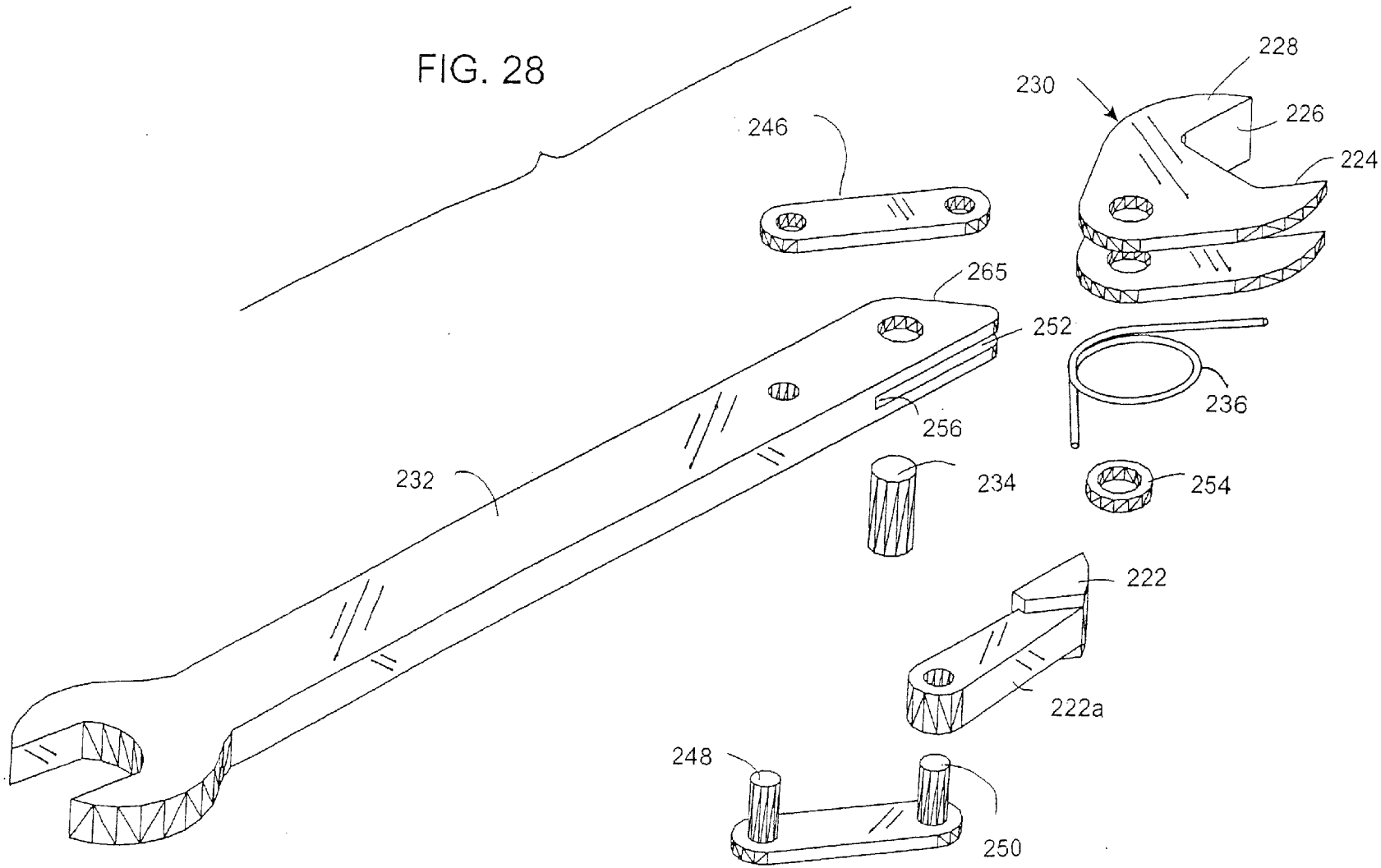
FIG. 28 is an exploded view showing the components of the wrench.
Figure 29:
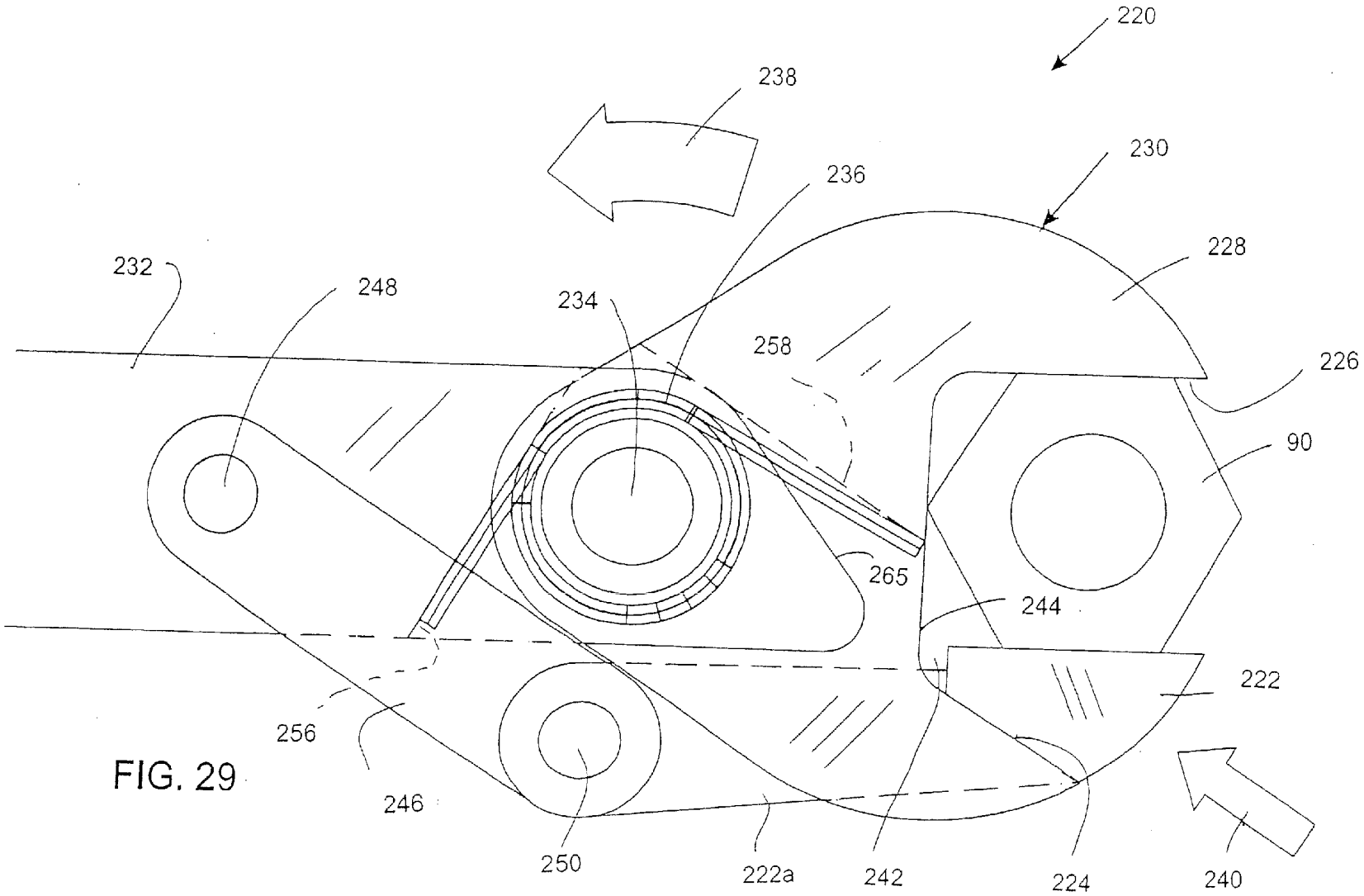
FIG. 29 is a schematic view demonstrating operation of the wrench.

The exploded view of FIG. 28 shows the preferred construction for the wrench 220. The coiled torsion spring 236 is assembled into a slot 252 in the end of the handle, preferably along with a washer 254. The deep end 256 of the slot 252 provides a bracing surface against which the torsion spring acts, as can be seen from both FIGS. 28 and 29. The other leg of the torsion spring engages against an internal wall 258 of the head, as best seen in FIG. 29.

FIGS. 30A–B and 31A–D demonstrate the manner in which the tool 220 engages a nut and ratchets, when rotated in the non-work direction. To engage a nut when the jaw clearance is set to slightly less than the nominal nut or bolt width, the jaws can be opened slightly by pushing the thumb against a fixed jaw side of the head, as indicated by the arrow 260 in FIG. 30A. This flexes the head in the clockwise direction relative to the handle, against the force of the torsion spring, causing the linkage arm 246 to slide the jaw wedge 222 outwardly, increasing the jaw clearance. The head is then released, and the spring engages the nut as explained above and shown in FIG. 29. When the jaw wedge 222 is thus slid outwardly, without a nut being gripped, the wedge is free to move away from the jaw guide 224, toward the fixed jaw 228. This can be prevented, if desired, by slotting the internal faces of the jaw guides 224 and providing ridges on the shank of the movable jaw member 222*a*, to slide in the slots, which would be parallel to the jaw guides 224. This or any other suitable mechanical retention arrangement can be used if desired (no retention arrangement shown in the drawings).

Figure 30B:
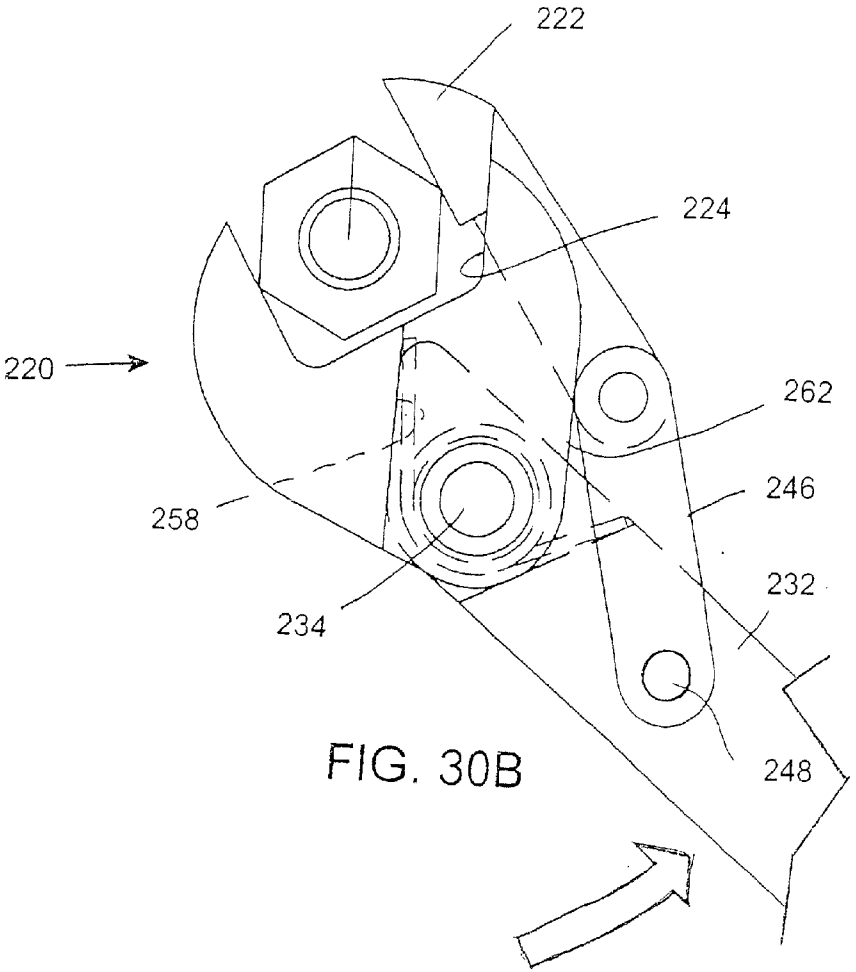
FIGS. 30A and 30B are companion views showing the manner in which the wrench ratchets.
Figure 30A:
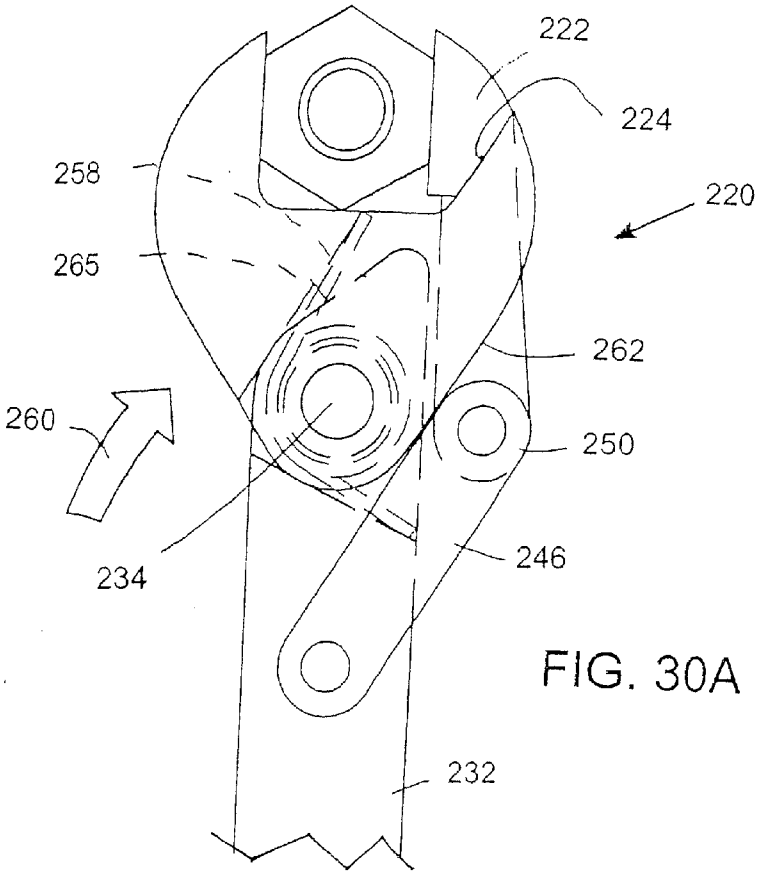

As seen in FIGS. 30A and 30B, the sliding plane 224 of the wrench head is parallel to an outer surface 262 of the head. This assures that the jaw surfaces stay parallel as the jaws spread apart with flexing of the handle. The linkage arm 246, at its pivot end 250, rides along this surface 262 as the movable jaw slides outwardly or inwardly. This parallelism of the jaw surfaces is important so that the wrench can be used on different sizes of nuts, such as on English-size nuts as well as the closest metric size.

FIGS. 30A and 30B also show that the wrench has a means of limiting the movement of the handle so the slidable jaw 222 will not open more than necessary. This limit preferably is established by surfaces 258 and 265 which ultimately come in contact as indicated in FIG. 30B, limiting further pivoting of the handle about the pivot 234. The surface 265 is the angled end of the handle, while the surface 258 is the internal wall of the wrench head, seen also in FIG. 29. Preferably this limit is set to allow the jaws to open at least as wide as needed for the largest nut size anticipated for the wrench.

Figures 31A, 31B, 31C, 31D:
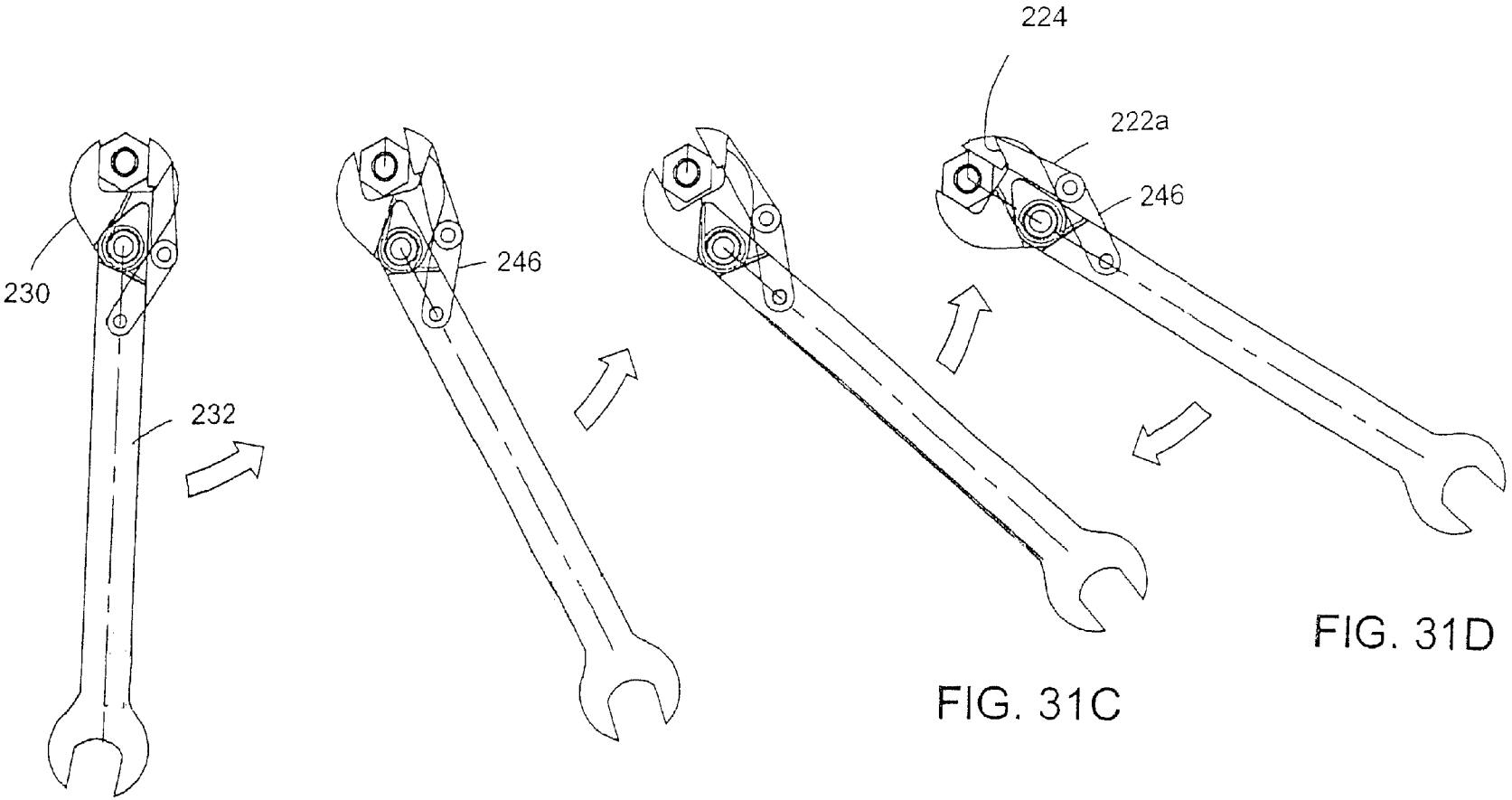
FIGS. 31A–31D are a series of views showing different positions the wrench assumes during ratcheting on a nut.

To move the wrench 60° to allow a new stroke of work movement on a hex nut or bolt, the wrench is rotated in the counterclockwise direction as in FIGS. 30B and 31A–D. The outward movement of the jaw wedge 222, as the wrench handle 232 flexes relative to the head 230, progressively increases the jaw opening clearance, due to the action of the linkage arm 246 and the sliding of the jaw up the oblique jaw guide plane 224. As shown in the drawing, when the wrench handle has been rotated about 50° relative to the nut in this preferred form of the invention, the wrench head has been rotated only about 30°. This is approximately (but not necessarily) the point of maximum jaw opening, where the jaws are wide enough to slip over the larger dimension of the hexagonal nut as shown in FIG. 31C. Beyond that, the jaws begin to close and the wrench head and handle begin to move back toward their original position under the influence of the torsion spring. FIG. 31D shows the completion of this ratcheting movement, where the tool is ready for an arc of movement in the work direction, clockwise in these figures. Movement of the wrench in the work direction prevents the jaw from opening further, because the linkage arm 246 and the jaw member 222*a* are now in tension, tending to pull the jaw wedge 222*a* more deeply into the wrench head, along the oblique plane 224, and thus tending to grip the nut more tightly.

The ratcheting wrenches of FIGS. 19–25B and 26–31D work on a similar principle in that a wedge-shaped movable jaw slides on an obliquely angled plane to open the jaw clearance wider for ratcheting and to close the jaws tightly on a nut in the work direction. However, the two wrenches in one sense work oppositely, with the first wrench locking onto the nut when the handle is rotated in the direction of the movable jaw, but with the second wrench releasing when the handle is rotated toward the movable jaw. The main difference is that in the second wrench, the jaw is not allowed to slide outwardly in the work direction, because the linkage engaged with the movable jaw is in tension, tending to pull the wedge deeper into the head and more tightly onto the nut. In the first wrench, this same direction of movement encounters no resistance other than a spring, and the nut facets are effective to slide the jaw outwardly as the wrench is pivoted around the nut in the clockwise direction as seen in the drawings. When the first wrench is used in the work (counterclockwise) direction, the reaction forces on the wrench (see FIGS. 25A–B) have only a very slight tendency to slide the jaw outwardly, insufficient to overcome friction between components because of the soft jaw guide angle. The second wrench when moved in this same direction actually pushes the wedge outwardly through the action of the linkage, as the handle pivots relative to the head.

Figure 32B:
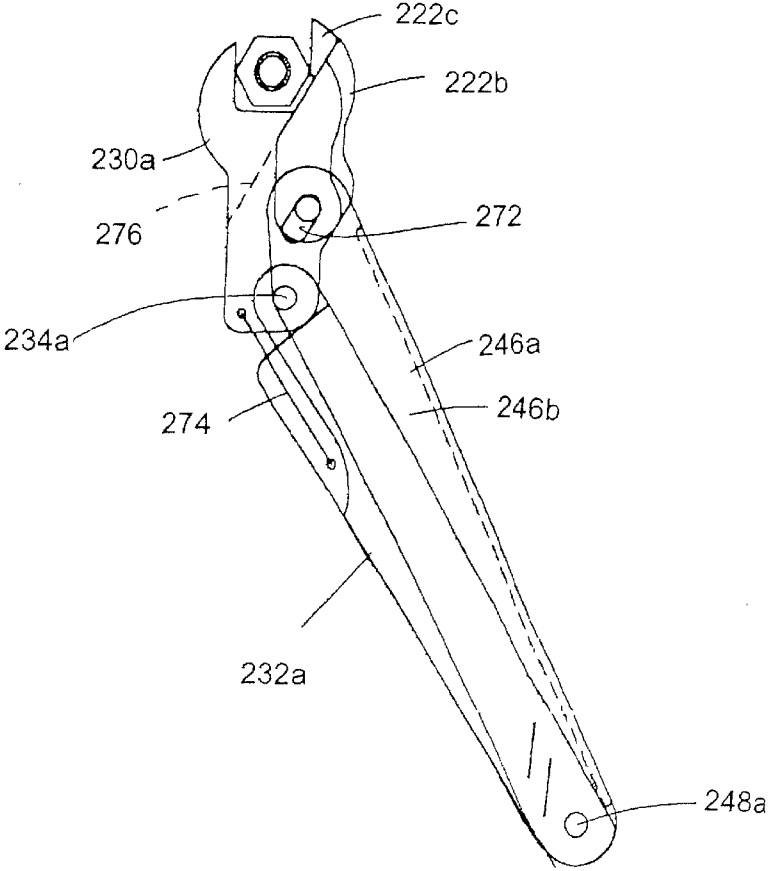
FIGS. 32A and 32B show a modified form of the wrench of FIGS. 26–31D, with a greater leverage for engaging a nut or bolt.
Figure 32A:
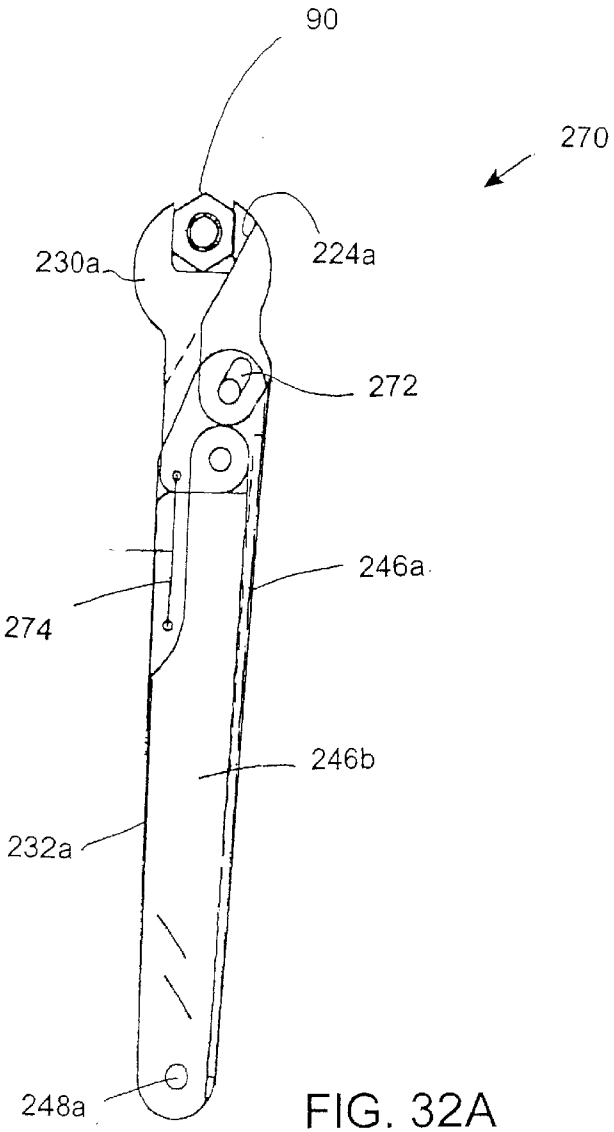

FIGS. 32A and 32B show another version of a ratcheting wrench 270, similar to the wrench 220 but with some modifications. In this wrench the linkage member 246*a* is elongated, extending down the handle to a remotely placed pivot point 248*a* which preferably (but not necessarily) is at the remote end of the handle 232*a*. Also, the movable jaw member 222*b* extending from the movable jaw wedge 222*c* is retained in its parallel path along the jaw guide 224*a* by a slotted opening 272 in the wrench head 230*a* as shown, rather than by the linkage member riding against an outside surface of the wrench head, as in the last-described version of the wrench. This slot 272, arranged parallel to the jaw guide 224*a*, also provides an outer limit for outward sliding of the movable jaw wedge 222*c*, as shown in FIG. 32B. Thus, the wrench handle need not have a rotational limit stop device as in the previously described wrench. A tension spring 274 is schematically indicated, and this spring tends to pivot the handle back to its normal position as shown in FIG. 32A. The elongated linkage arm 246*a* provides a very strong leverage for gripping the nut or bolt 90 as the wrench handle is swung in the direction clockwise as viewed in FIGS. 32A–B. The linkage pivot point 248*a* to the handle could be located farther up the handle, toward the head, if desired, but the arrangement shown is preferred. As the drawings illustrate, the slot 272 is configured and sized such that the movable jaw member 222*b* cannot slide so far that the jaw wedge 222*c* slips off the jaw guide 224*a*.

The views of FIGS. 32A and 32B are schematic in showing the principles of operation and construction of the tool. The wrench head 230*a* preferably is solid in the region left and below the hut as seen in the drawings, but clevis-shaped in the region to the right of the dashed line 276, somewhat similar to the wrench head 230 discussed above. The movable wedge member 222*b* resides within this clevis, as does the wrench handle 232*a* at the pivot point 234*a*. The linkage member 246*a* can be of an open construction, with a pair of side wings 246*b*, one of which is seen in FIGS. 32A–B, one each side of the wrench, straddling both the wrench head and the handle.

Figures 33A, 33B, 33C, 33D, 33E:
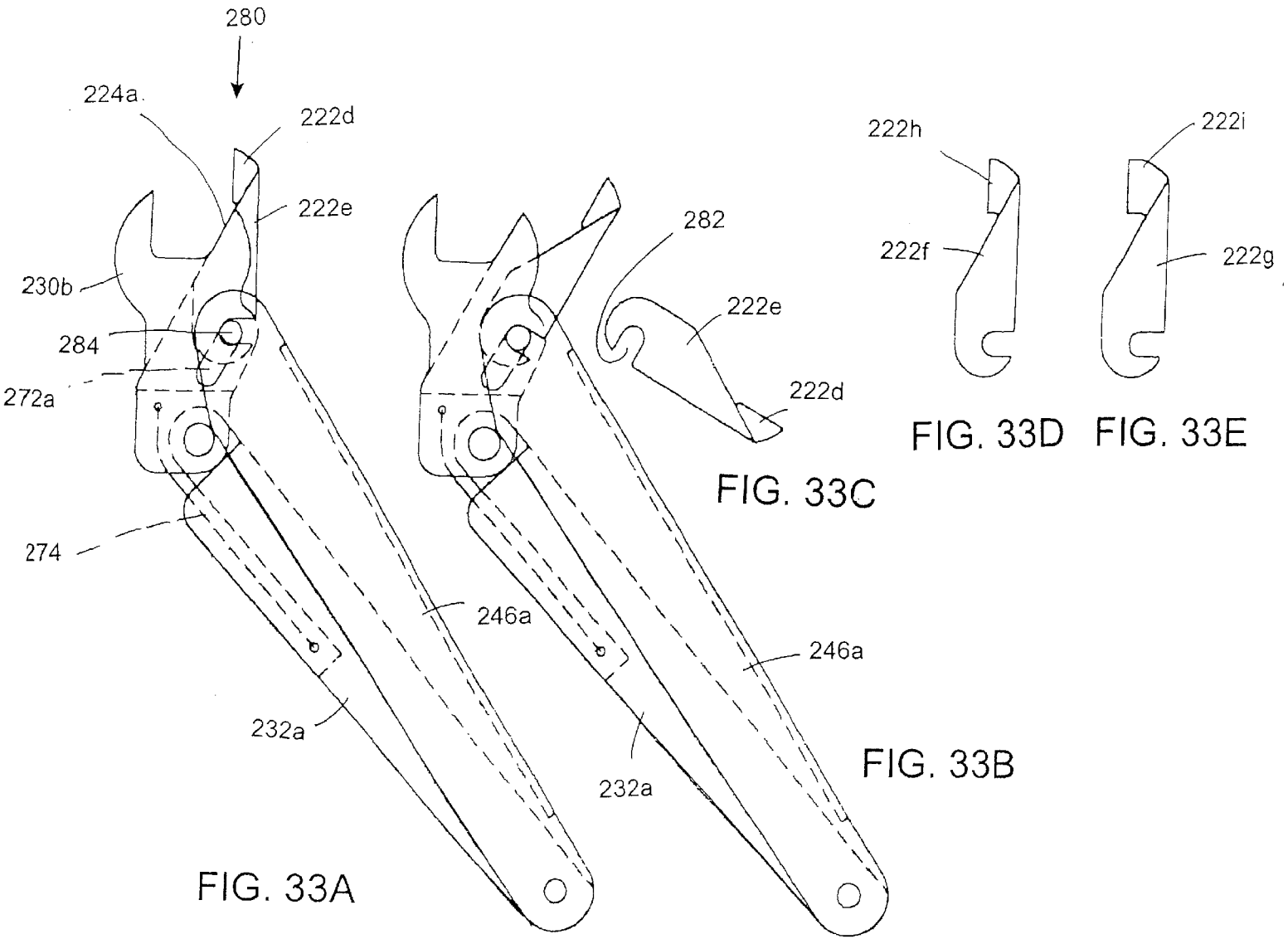
FIGS. 33A–33E show a modified form of the wrench of FIGS. 32A–B, providing for interchangeable movable jaw members to accommodate a range of nut sizes.

FIGS. 33A–E and 34A–C show another version of a ratcheting wrench, similar to that of FIGS. 32A–B, but providing for a range of different nut sizes. FIGS. 35A–35B show the wrench in perspective, while FIG. 36 in an exploded view. The wrench 280 has a handle 232*a* and an elongated linkage member 246*a* as in the previously described wrench, but the jaw guiding slot 272*a* in the head 230*b* of this wrench is longer, extending far enough to allow the adjustable jaw wedge 222*d* of the movable jaw member 222*e* to move beyond the bounds of the angled jaw guide surface 224*a*, which is parallel to the slot 272*a*. Thus, when the handled is moved to the extreme position shown in FIGS. 33A and 33B, the movable jaw member 222*e* can easily be removed by rotating it back as shown in FIG. 33B and removing it as shown in FIG. 33C. For this purpose the movable jaw member has a hook or slot 282 to engage with the pin 284, rather than a completely captive connection provided by a hole.

This allows replacement of the movable jaw member with any of several additional movable jaw members 222*f* and 222*g* which have somewhat deeper jaw wedges 222*h* and 222*i*. The wrench is simply held in the extreme position shown, with a thumb or fingers, while the movable jaw member is replaced. This gives the wrench a wide range of nut sizes, since each individual jaw member can itself accommodate a small range of nut sizes.

Figure 34C:
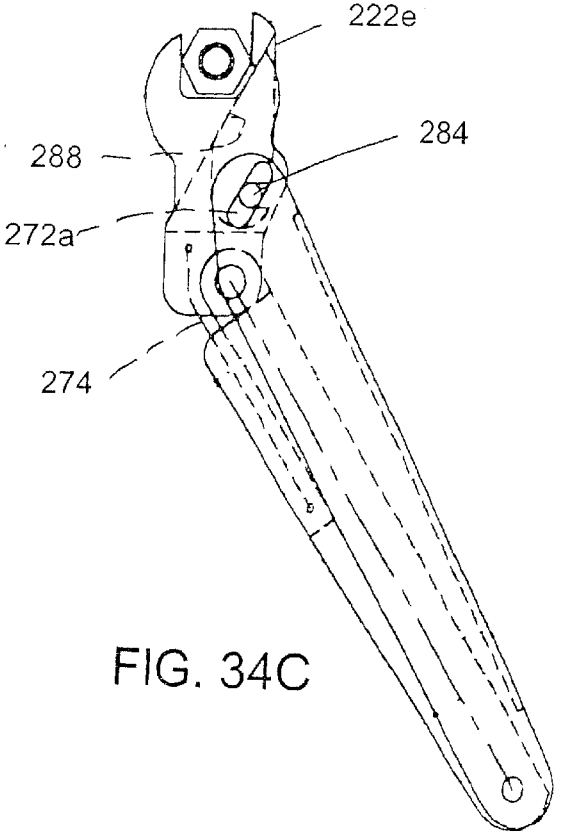
FIGS. 34A–34C show use of the wrench of FIGS. 33A–E.
Figure 34B:
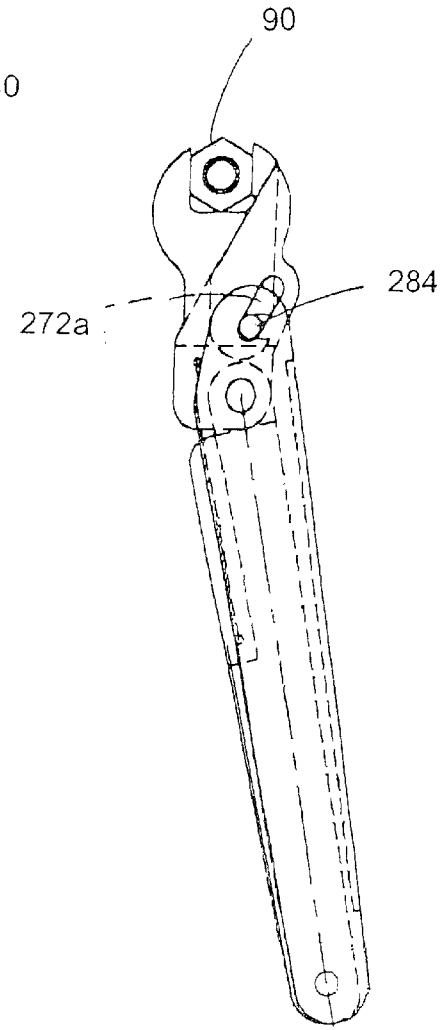
Figure 34A:
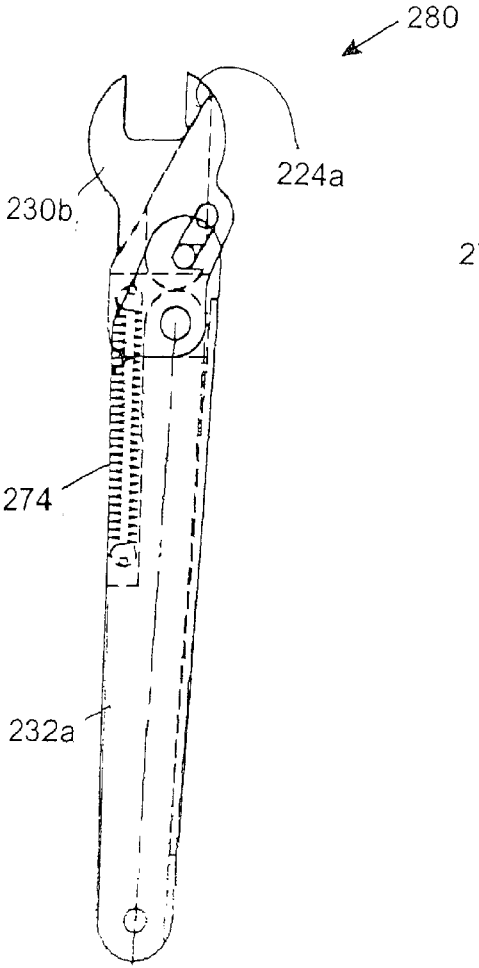
Figures 35A, 35B:
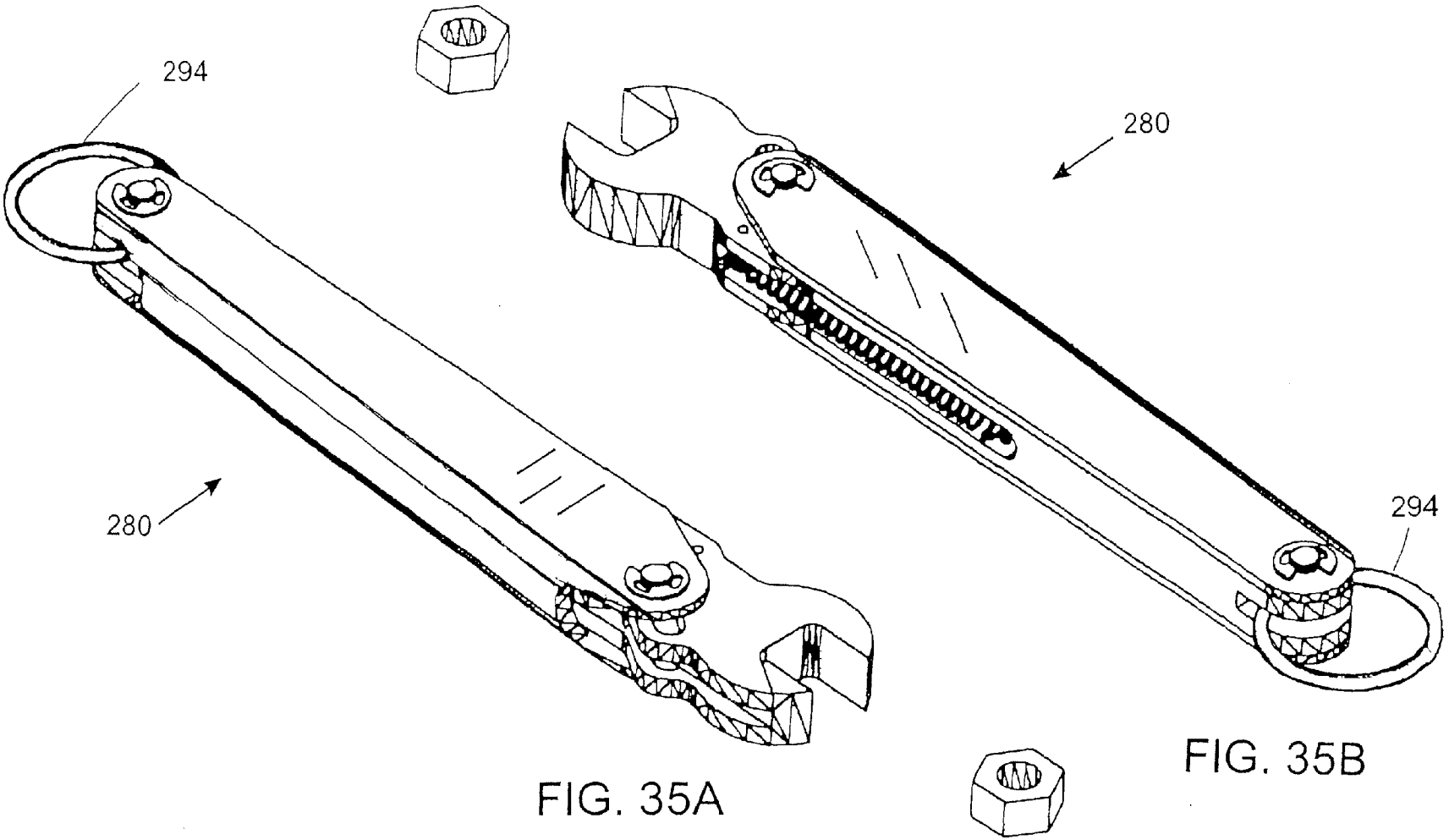
FIGS. 35A and 35B show the wrench of FIGS. 33A–E in perspective.

FIGS. 34A–C show use of the adjustable-size ratcheting wrench 280. The wrench in FIG. 34A is in the normal position, with the head 230*b* and handle 232*a* held in essentially straight position under the influence of the tension spring 274. As indicated, and as discussed previously, this "normal" position preferably is at a jaw clearance slightly less than the nominal size of the nut or bolt. Thus, if the nut 90 is one-half inch in size, the jaw separation in the position of FIG. 34A might be approximately 0.489 inch. This is for positive gripping of the nut, as discussed above.

FIG. 34B shows that the wrench handle preferably is pivoted slightly, with the linkage arm/movable jaw pivot pin 284 displaced slightly within the slot 272*a*, when the nut 90 has been gripped. FIG. 34C shows the position of the wrench when it is being rotated in the direction counterclockwise in these drawings, and wherein the wrench jaws are passing over the approximate maximum dimension of the nut. In this position, the linkage arm/movable jaw pivot pin 284 is displaced to a considerable degree within the elongated slot 272*a*, but the movable jaw member 222*e* will not escape from the wrench head because of the influence of the spring 274 and the captive effect of the jaw guide 224*a* and the engagement of the movable jaw member 222*e* against an interior planar surface 288 of the wrench head. Only when the wrench is deliberately pivoted to the extreme position shown in FIGS. 33A–B can the movable jaw member be removed from the wrench head and replaced.

Figure 36:
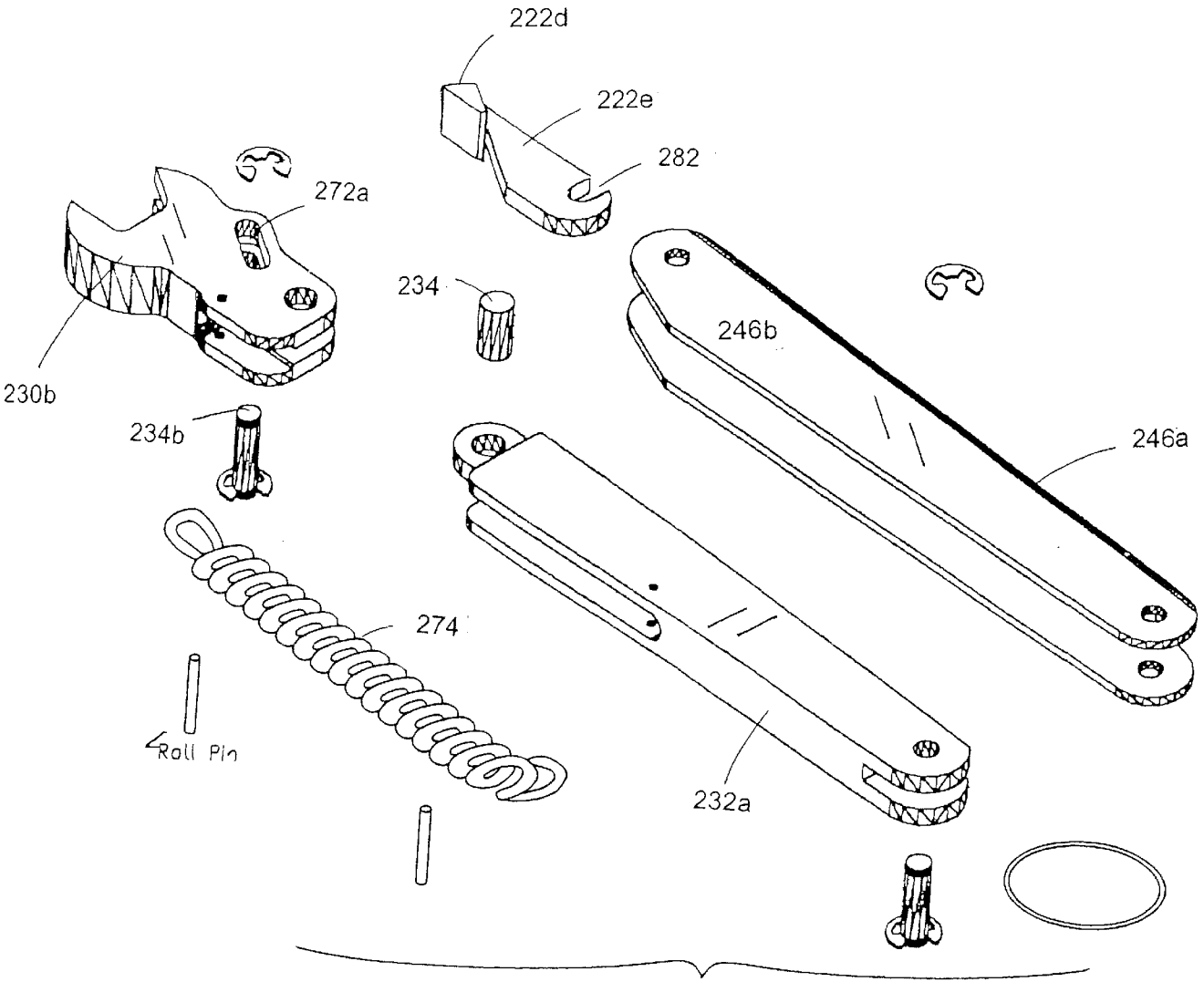
FIG. 36 is an exploded perspective view showing the same wrench.

As seen in the perspective views of FIGS. 35A–B, the interchangeable-jaw wrench 280 can have a key chain ring 294 at the remote end of the handle, the entire wrench when in the unused position being relatively compact. The exploded perspective of FIG. 36 shows the various components, including a pin 234*b* which connects the proximal end of the handle 232*a* to the wrench head 230*b*, the pin 284 that connects the elongated linkage member 246*a* to the head at the slot 272*a*, the key chain ring 294, the removable jaw 222*d*, and various assembly components.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A ratcheting adjustable wrench, comprising:

an elongated handle having an outer end and an inner end, the inner end having means for pivotal connection to a head at a head pivot point, a head connected to the handle at said head pivot point and having a fixed jaw member and including a movable jaw member mounted in the head for sliding adjustment toward and away from the fixed jaw member, the head also having an adjustment screw mounted for rotation in the head and engaged in a toothed rack on the movable jaw member for adjustment of the movable jaw member, toward and away from the fixed jaw member, the adjustment screw being slidable generally axially in the head along with the movable jaw member, and further including a slidable wedge positioned to provide a support at a lower end of the adjustment screw to prevent axial movement of the adjustment screw and corresponding sliding of the movable jaw member away from the fixed jaw member, the wedge having a fully supporting location at one end of its permitted sliding travel and being shaped to provide progressively lower support for the screw as the wedge slides in a retracting direction, and the head including a slide channel receiving the slidable wedge for sliding movement therein, linkage means connected pivotally to the wedge and to the handle, such that when the wrench handle is rotated in a work direction generally toward the movable jaw member, the linkage means is engaged in compression to force the wedge member toward its fully supporting location for the screw, thus locking the slidable screw and connected movable jaw in a position to prevent backing off of the movable jaw during tightening of a nut or bolt, and whereby when the wrench handle is rotated in an opposite, non-work direction generally away from the movable jaw, the force rotating the handle retracts the slidable wedge via pulling of the linkage means, to retract the support of the adjustment screw and thus to allow the movable jaw to move away from the fixed jaw, allowing the wrench to slip along facets of the nut or bolt to move to another position from which further work rotation of the nut or bolt can be achieved.

2. The wrench of claim 1, wherein the linkage means comprises a linkage member having two ends, one pivotally connected to the slidable wedge and the other pivotally connected to the handle.

3. The wrench of claim 1, wherein the linkage means comprises a pivot connection directly connecting the handle and the slidable wedge.

4. The wrench of claim 1, wherein the head includes a rear extension beyond the head pivot point extending above an upper side of the handle as a protruding knob, so as to be located as a convenient pressure point to pivot the head on the handle by force from a thumb or finger.

5. A ratcheting adjustable wrench, comprising:

an elongated handle having an outer end and an inner end, the inner end having means for pivotal connection to a head at a head pivot point, a head connected to the handle at said head pivot point and having a fixed jaw member, a movable jaw member slidingly connected to the head for sliding adjustment movement toward and away from the fixed jaw member, an adjustment member mounted for sliding movement in the head along with the movable jaw member and adjustably engaged with the movable jaw member so as to permit adjustment of the movable jaw member's slide position in the head, for a given position of the adjustment member, a slidable wedge positioned to provide a support at a lower end of the adjustment member to prevent downward sliding movement of the adjustment member and corresponding sliding of the movable jaw member away from the fixed jaw member, the wedge having a fully supporting location at one end of its permitted sliding travel and being shaped to provide progressively lower support for the adjustment member as the wedge slides in a retracting direction, and the head including a slide channel receiving the slidable wedge for sliding movement therein in a direction oblique relative to the sliding movement of the adjustment member, linkage means connected pivotally to the wedge and to the handle, such that when the wrench handle is rotated in a work direction generally toward the movable jaw member, the linkage means is engaged in compression to force the wedge member toward its fully supporting location for the adjustment member, thus locking the slidable adjustment member and connected movable jaw in a position to prevent backing off of the movable jaw during tightening of a nut or bolt, and whereby when the wrench handle is rotated in an opposite, non-work direction generally away from the movable jaw, the force rotating the handle retracts the wedge member via the linkage means, to retract the support of the adjustment member and thus to allow the movable jaw to move away from the fixed jaw, allowing the wrench to slip along facets of the nut or bolt to move to another position from which further work rotation of the nut or bolt can be achieved.

6. The wrench of claim 5, wherein the linkage means comprises a linkage member having two ends, one pivotally connected to the slidable wedge and the other pivotally connected to the handle.

7. The wrench of claim 5, wherein the linkage means comprises a pivot connection directly connecting the handle and the slidable wedge.

8. The wrench of claim 5, wherein the head includes a rear extension beyond the head pivot point extending above an upper side of the handle as a protruding knob, so as to be located as a convenient pressure point to pivot the head on the handle by force from a thumb or finger.

9. The wrench of claim 5, wherein the adjustment member comprises an adjustment screw mounted for rotation in the head, and including a toothed rack on the movable jaw member and in engagement with the adjustable screw such that rotation of the screw effects sliding adjustment movement of the movable jaw.

10. The wrench of claim 5, wherein the adjustment member has a rack of teeth, and the movable jaw member has a similar, opposed and parallel-oriented rack of teeth, the two racks of teeth being engaged in a normal work condition of the wrench, with means on the wrench for manually disengaging the racks when adjustment of the wrench is desired and for re-engaging the racks in a shifted position.

11. The wrench of claim 10, wherein the adjustment member comprises a slidable block, and the means for manually disengaging the racks comprises an adjustment lever on a side of the wrench head, with a normal locking position effective to lock the tooth block with its rack of teeth in engagement with the movable jaw member's rack of teeth, and with a pivoted adjustment position which allows the tooth block to move away from the movable jaw and disengage the racks of teeth, allowing the movable jaw to be moved to a new jaw separation position.

* * * * *